US011431103B2

(12) United States Patent
Baligh et al.

(10) Patent No.: US 11,431,103 B2
(45) Date of Patent: Aug. 30, 2022

(54) SYSTEMS AND METHODS FOR BEAMFORMING USING INTEGRATED CONFIGURABLE SURFACES IN ANTENNA

(71) Applicants: Mohammadhadi Baligh, Ottawa (CA); Ahmad Abu Al Haija, Ottawa (CA)

(72) Inventors: Mohammadhadi Baligh, Ottawa (CA); Ahmad Abu Al Haija, Ottawa (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 112 days.

(21) Appl. No.: 16/932,100

(22) Filed: Jul. 17, 2020

(65) Prior Publication Data

US 2022/0021125 A1 Jan. 20, 2022

(51) Int. Cl.

*H01Q 15/14* (2006.01)
*H01Q 21/06* (2006.01)
*H01Q 19/10* (2006.01)

(52) U.S. Cl.

CPC ..... *H01Q 15/148* (2013.01); *H01Q 19/10* (2013.01); *H01Q 21/06* (2013.01); *H01Q 21/061* (2013.01); *H01Q 21/065* (2013.01)

(58) Field of Classification Search

CPC .... H01Q 1/523; H01Q 21/065; H01Q 15/148; H01Q 19/062; H01Q 3/46; H01Q 19/06; H01Q 3/01; H01Q 3/2676; H01Q 3/44; H01Q 19/10; H01Q 21/06; H04B 7/0617; H04B 7/0413

See application file for complete search history.

(56) References Cited

U.S. PATENT DOCUMENTS

| | | | | |
|---|---|---|---|---|
| 9,374,145 | B2 * | 6/2016 | Angeletti | H04B 7/0691 |
| 10,211,906 | B1 * | 2/2019 | Nam | H04B 7/0452 |
| 10,446,927 | B2 * | 10/2019 | Achour | G01S 7/411 |
| 11,005,192 | B2 * | 5/2021 | Dani | H01Q 21/005 |

(Continued)

FOREIGN PATENT DOCUMENTS

| | | | |
|---|---|---|---|
| CN | 111010219 | A | 4/2020 |
| CN | 111416646 | A | 7/2020 |
| WO | 2019060782 | A1 | 3/2019 |

OTHER PUBLICATIONS

Intelligent Reflecting Surface Aided Wireless Communication: Opportunities and Challenges. Rui Zhang (Year: 2020).*

(Continued)

*Primary Examiner* — Vibol Tan

(57) ABSTRACT

Aspect of the present disclosure provide a device that includes an array of subarrays (AoSA) comprising a plurality of subarrays, each subarray including a plurality of antenna elements and a reconfigurable intelligent surface (RIS) that includes a plurality of configurable elements. The AoSA and the RIS are spaced apart from one another such that each subarray and a corresponding subset of the plurality of configurable elements are in each other's near field. Some embodiments described in the disclosure allow large spacing between antenna elements of the AoSA, thereby enabling lower complexity in circuit implementation for power amplification and phase shifting that may be associated with each antenna element, especially as high frequencies where spacing between antenna elements decreases and in some embodiments, reduces the number of antennas that are used.

20 Claims, 13 Drawing Sheets

(56) References Cited

U.S. PATENT DOCUMENTS

| | | | | |
|---|---|---|---|---|
| 2011/0302561 | A1* | 12/2011 | Dayan | G06F 11/3466 717/128 |
| 2016/0013549 | A1 | 1/2016 | Schaffner et al. | |
| 2018/0316090 | A1 | 11/2018 | Foo | |

OTHER PUBLICATIONS

Intelligent Surface-Aided Transmitter Architectures for Millimeter Wave Ultra Massive MIMO Systems. Vahid Jamali et al. (Year: 2021).*

Intelligent Reflecting Surfaces: Fundamentals and Applications. Emad Ibrahim. NPL Year Unknown. (Year: NA).*

Jamali, Vahid, et al., "Intelligent Reflecting and Transmitting Surface Aided Millimeter Wave Massive MIMO", Sep. 23, 2019, Available Online: arXiv:1902.07670v2, https://arxiv.org/abs/1902.07670v2.

Hum, Sean Victor and Perruisseau-Carrier, Julien, "Reconfigurable Reflectarrays and Array Lenses for Dynamic Antenna Beam Control: A Review", IEEE Transactions on Antennas and Propagation, Jan. 2014, vol. 62, No. 1, pp. 183-198.

* cited by examiner

SYSTEMS AND METHODS FOR BEAMFORMING USING INTEGRATED CONFIGURABLE SURFACES IN ANTENNA

TECHNICAL FIELD

The present disclosure relates generally to wireless communications, and in particular embodiments, use of configurable surfaces in an antenna for beamforming.

BACKGROUND

In some wireless communication systems, user equipments (UEs) wirelessly communicate with a base station (or gNB) to send data to the base station and/or receive data from the base station. A wireless communication from a UE to a base station is referred to as an uplink (UL) communication. A wireless communication from a base station to a UE is referred to as a downlink (DL) communication. A wireless communication from a first UE to a second UE is referred to as a sidelink (SL) communication or device-to-device (D2D) communication.

Resources are required to perform uplink, downlink and sidelink communications. For example, a base station may wirelessly transmit data, such as a transport block (TB), to a UE in a downlink transmission at a particular frequency and over a particular duration of time. The frequency and time duration used are examples of resources.

For either uplink or downlink transmissions, beamforming is a technique that directs a wireless signal towards a particular receiving device, instead of allowing a signal to spread in a broader direction. Beamforming is an important aspect to the 5G networks. One technique for beamforming a signal involves utilizing multiple antennas in close proximity, all broadcasting a same signal at slightly different times. The overlapping transmitted waves produce interference that in some areas is constructive, making the signal stronger, and in other areas is destructive, making the signal weaker, or cancelling the signal.

SUMMARY

According to an aspect of the disclosure, there is provided a device including an array of subarrays (AoSA), including a plurality an array of subarrays (AoSA) including a plurality of subarrays, each subarray comprising a plurality of antenna elements and a reconfigurable intelligent surface (RIS) comprising a plurality of configurable elements, wherein the AoSA and the RIS are spaced apart from one another such that each subarray and a corresponding subset of the plurality of configurable elements are in each other's near field. The near field being less than a distance determined in accordance with a maximum linear dimension of a subarray of the AoSA or a subset of the plurality of configurable elements corresponding to the subarray and a frequency that belongs to an operational frequency range of the AoSA.

In some embodiments, the distance is determined based on $$\frac{2L^2}{\lambda},$$

where L is the largest value of either the maximum linear dimension of the subarray of the AoSA or the maximum linear dimension of a subset of the plurality of configurable elements corresponding to the subarray and $\lambda$ is a wavelength defined as c/f where c is the speed of light and f is the frequency that belongs to the operational frequency range of the AoSA.

In some embodiments, a radio frequency (RF) chain is electrically coupled to a single AoSA antenna elements or two or more AoSA antenna elements.

In some embodiments, the RF chain is electrically coupled to a digital precoder.

According to an aspect of the disclosure, there is provided a method involving transmitting a signal, by an AoSA including a plurality of subarrays, each subarray including a plurality of antenna elements, and redirecting the transmitted signal by a RIS including a plurality of configurable elements, wherein the AoSA and the RIS are spaced apart from one another such that each subarray and a corresponding subset of plurality of configurable elements are in each other's near field, the near field being less than a distance determined in accordance with a maximum linear dimension of a subarray of the AoSA or a subset of the plurality of configurable elements corresponding to the subarray and a frequency that belongs to an operational frequency range of the AoSA.

In some embodiments, the distance is determined based on $$\frac{2L^2}{\lambda},$$

where L is the largest value of either the maximum linear dimension of the subarray of the AoSA or the maximum linear dimension of a subset of the plurality of configurable elements corresponding to the subarray and $\lambda$ is a wavelength defined as c/f where c is the speed of light and f is the frequency that belongs to the operational frequency range of the AoSA.

According to an aspect of the disclosure, there is provided a method involving redirecting, by a RIS including a plurality of configurable elements, a signal; and receiving, by an AoSA including a plurality of subarrays, each subarray including a plurality of antenna elements, the signal redirected by the plurality of configurable elements, wherein the AoSA and the RIS are spaced apart from one another such that each subarray and a corresponding subset of the plurality of configurable elements are in each other's near field, the near field being less than a distance determined in accordance with a maximum linear dimension of a subarray of the AoSA or a subset of the plurality of configurable elements corresponding to the subarray and a frequency that belongs to an operational frequency range of the AoSA.

In some embodiments, the distance is determined based on $$\frac{2L^2}{\lambda},$$

where L is the largest value of either the maximum linear dimension of the subarray of the AoSA or the maximum linear dimension of a subset of the plurality of configurable elements corresponding to the subarray and $\lambda$ is a wavelength defined as c/f where c is the speed of light and f is the frequency that belongs to the operational frequency range of the AoSA.

Aspects of the disclosure propose use of fewer and largely spaced apart antenna elements, on the AoSA resulting in a larger spacing between the antenna elements. The use of a high density of reconfigurable elements on the RIS in front of the antennas i) attenuates the side-lobe pertaining to the large spacing of the antenna elements and ii) provides additional beamforming gain to either increase the gain (if the same number of antennas used) or compensate the gain reduction resulting from reducing the number of antennas.

The large spacing between antenna elements of the AoSA enables lower complexity in circuit implementation for power amplification and phase shifting that may be associated with each antenna element, especially as high frequencies where spacing between antenna elements decreases and in some embodiments, reduces the number of antennas that are used.

Some embodiments, for example when the AoSA is formed in a hemispherical shape or off to the side of the RIS, and the RIS is being used in a reflective manner back toward the AoSA, may aid in reducing a radiation shadow resulting from the AoSA.

BRIEF DESCRIPTION OF THE DRAWINGS

For a more complete understanding of the present embodiments, and the advantages thereof, reference is now made, by way of example, to the following descriptions taken in conjunction with the accompanying drawings, in which.

DETAILED DESCRIPTION OF ILLUSTRATIVE EMBODIMENTS

Figure 1:
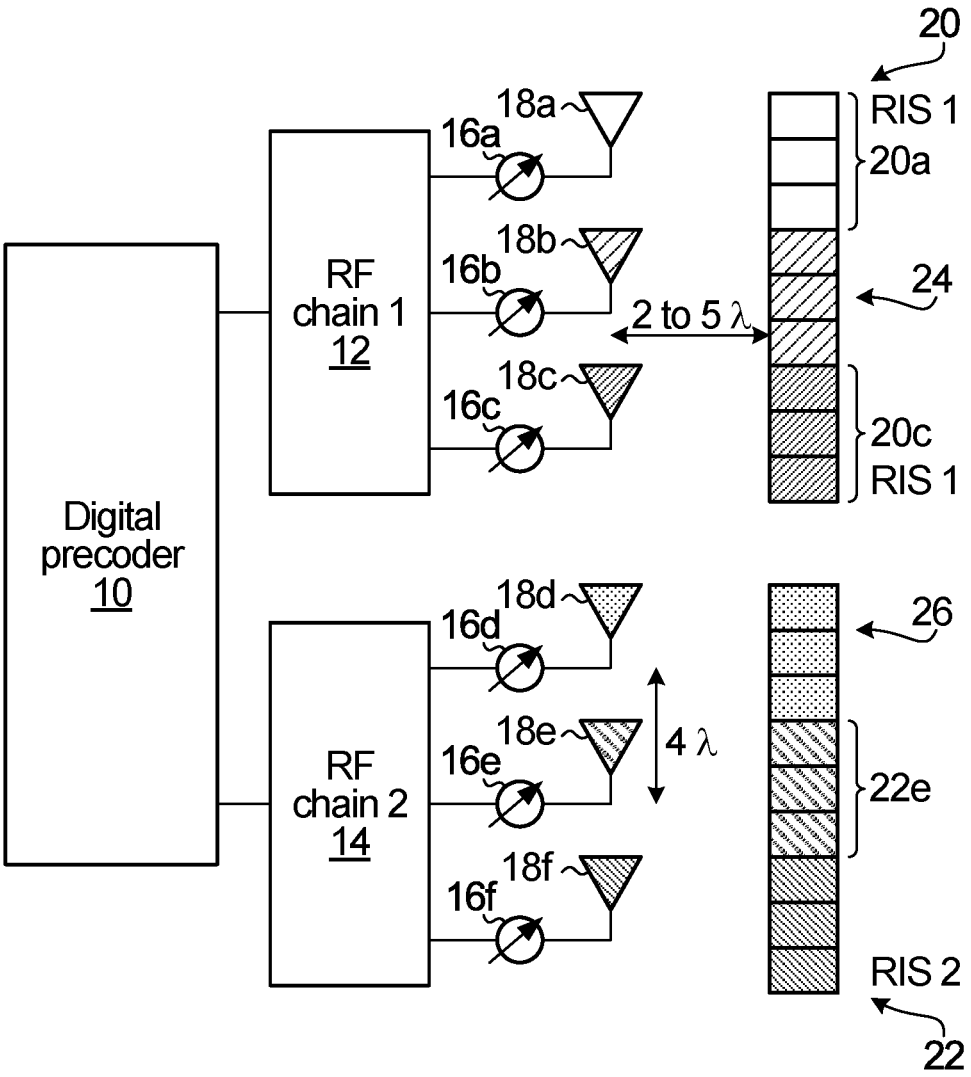
FIG. 1 is a schematic diagram of a combined subarray antenna array and reconfigurable intelligent surface (RIS) according to an aspect of the disclosure.

For illustrative purposes, specific example embodiments will now be explained in greater detail below in conjunction with the figures.

The embodiments set forth herein represent information sufficient to practice the claimed subject matter and illustrate ways of practicing such subject matter. Upon reading the following description in light of the accompanying figures, those of skill in the art will understand the concepts of the claimed subject matter and will recognize applications of these concepts not particularly addressed herein. It should be understood that these concepts and applications fall within the scope of the disclosure and the accompanying claims.

Moreover, it will be appreciated that any module, component, or device disclosed herein that executes instructions may include or otherwise have access to a non-transitory computer/processor readable storage medium or media for storage of information, such as computer/processor readable instructions, data structures, program modules, and/or other data. A non-exhaustive list of examples of non-transitory computer/processor readable storage media includes magnetic cassettes, magnetic tape, magnetic disk storage or other magnetic storage devices, optical disks such as compact disc read-only memory (CD-ROM), digital video discs or digital versatile discs (i.e. DVDs), Blu-ray Disc™, or other optical storage, volatile and non-volatile, removable and non-removable media implemented in any method or technology, random-access memory (RAM), read-only memory (ROM), electrically erasable programmable read-only memory (EEPROM), flash memory or other memory technology. Any such non-transitory computer/processor storage media may be part of a device or accessible or connectable thereto. Computer/processor readable/executable instructions to implement an application or module described herein may be stored or otherwise held by such non-transitory computer/processor readable storage media.

At higher frequency bands up to sub-THz, effective antenna aperture decreases. Effective antenna aperture is a theoretical value that is a measure of how effective an antenna is at receiving power. The effective aperture can be calculated by knowing the gain of the receiving antenna. To compensate for a reduced antenna aperture and a lower radiated power at a transmitter, multiple antenna elements can be used at the transmitter and/or receiver. However, having multiple antenna elements increases the implementation complexity with regard to the integration of radio frequency (RF) and power amplifier (PA) circuits for the antennas.

Multiple different techniques have been studied to provide improved effective antenna aperture while attempting to mitigate the complexity of the antenna.

In hybrid digital-analog beamforming (e.g. array of subarrays (AoSA)), several antennas (subarrays) are connected to one RF chain, which reduces the number of RF chains compared with the fully-digital beamforming. However, to have a narrow beam, many antenna elements are deployed in each subarray. These elements may each have a small power amplifier attached to them or one amplifier is connected to multiple antenna elements through power splitters and phase shifters. The inter-antenna spacing is usually half of the operating wavelength. While such a spacing allows independent control of the antennas and beam generation without side-lobes or with reduced side-lobes, the antennas need to be very closely spaced, especially at high frequencies, which complicates the circuit design and can cause power dissipation.

A lens antenna can be more energy efficient than analog antennas. However, to have a narrow beam at high frequency, the lens aperture should increase. The number of active antennas connected to the lens should increase as well in order to increase the number of beam directions so as to provide a broad coverage area. The scalability of the lens antennas is limited due to a high cost of the active antennas.

In hybrid digital-RIS beamforming, the beamforming is somewhat analogous to hybrid digital-analog beamforming. Specifically, it consists of multiple active antennas connected to a RF chain and illuminating a Reconfigurable Intelligent Surface (RIS).

A RIS, also known as large intelligent surface (LIS), smart reflect-array, intelligent passive mirrors, artificial radio space, reconfigurable metasurface, and holographic MIMO is an array of configurable elements. These configurable elements are also known as metamaterial cells or unit cells. A metamaterial (which may also be referred to as a Beyond-Material) is a material that is engineered to change its properties in order to manipulate one or more of the amplitude, phase, frequency, and polarization of a wave incident on the metamaterial. Manipulation of the amplitude and/or phase can be achieved by changing an impedance or relative permittivity (and/or permeability) of the metamaterial. At low frequencies, the impedance is controlled through lumped elements like PIN diodes, varactors, transistors or microelectromechanical system (MEMS). At higher frequencies, the relative permittivity and/or permeability of the material element (like liquid crystal at high frequencies and graphene at even higher frequencies) changes its permittivity in accordance to changes in a bias voltage provided to the material. Consequently, the phase of the signal redirected by the material is changed in accordance with the change in permittivity. As the bias voltages involved for these materials are quite low, the materials are often referred to as passive phase shifters.

The RIS performs analog beamforming by shifting the phases of the signals from the active antennas. While such a design is more power efficient than hybrid digital-analog beamforming and lens antenna array, a more flexible design is to utilize hybrid digital-analog-RIS beamforming, especially at high frequencies to allow even fewer RF chains deployment. The beamforming in this technique is effectively limited by the RIS. The speed of the antenna as a whole is limited to the speed of the RIS, the sensitivity of the beamforming is limited to the calibration of the RIS as the RIS makes a very narrow beam.

Because of their ability to manipulate the incident wave, the low cost of these types of devices, and because these types of devices require small bias voltages, RIS have recently received heightened research interest in the area of wireless communication as a valuable tool for beamforming and/or modulating communication signals.

In contrast to the previous works, the embodiments described in the present disclosure provide a new hybrid digital-analog-RIS beamforming. RIS beamforming increases the antenna aperture and gain and allows many antennas, which illuminate the RIS, to be largely spaced. This large spacing facilitates the high frequency RF and PA circuit deployment. The use of the RIS helps in compensating the side-lobes that result from the large spacing. This new hybrid digital-analog-RIS beamforming solution can be applied to base stations and UEs to enlarge the effective antenna aperture of these devices. However, in many cases, the effective antenna aperture of the UE is limited by the physical size of the UE.

Aspects of the disclosure are directed to solving the problem of enlarging the antenna aperture at high frequencies while allowing a simple integration of the RF and PA circuits and antennas.

Referring to FIG. 1, an exemplary solution of using two layers or two stages of analog beamforming will now be discussed. Embodiments of the disclosure provide a new hybrid beamforming that comprises conventional digital-analog beamforming in a first layer or first stage in addition to RIS beamforming as a second layer or second stage of analog beamforming.

FIG. 1 shows a digital precoder 10, two RF chains 12 and 14, multiple variable gain controllers 16*a* to 16*f*, an array of multiple antennas 18*a*-18*f* and two RIS devices 20 and 22, each formed of multiple configurable elements. The digital precoder 10 feeds the two RF chains 12 and 14. RF chain 12 is coupled to three variable gain controllers 16*a*, 16*b* and 16*c*. Each of the variable gain controllers 16*a*, 16*b*, 16*c* is coupled to respective antenna 18*a*, 18*b*, 18*c*. RF chain 14 has a similar arrangement of variable gain controllers 16*d*, 16*e*, 16*f* and antennas 18*d*, 18*e* and 18*f*. It may be considered in the case of FIG. 1 that antennas 18*a*, 18*b* and 18*c* are a first subarray and antennas 18*d*, 18*e* and 18*f* are a second subarray. While the subarrays in this example align with the two RF chains, this is not intended to limit the scope of the disclosure. For example, in other implementations there may be only a single RF chain feeding multiple subarrays, or a first RF chain may feed three subarrays, a second RF chain may feed five subarrays and a third RF chain may feed eight subarrays. While FIG. 1 shows that the subarrays for the two RF chains are separate, these subarrays can be overlapped as well, i.e., some antenna elements are connected to both RF chains (subarray connected RF chain 1 and subarray connected RF chain 2 have common one or more antenna elements). Similar applied to larger implementations with more subarrays and RF chains where some antennas are connected to one or more RF chains. Furthermore, in some embodiments, one or more antennas may be connected to more than one RF chain. The antennas 18*a*-18*f* are shown to be spread apart by approximately 4λ. The wavelength λ is defined as c/f where c is the speed of light and f is a frequency that belongs to the operational frequency range of the AoSA. As will be discussed below, there is a range of values that can be used for the spread of the antennas, as 4λ is merely any example of the possible spread. Spaced apart from the antennas are the two RIS 20 and 22. While two RIS are shown it is to be understood that there could be a single RIS or more than two RIS. The RIS 20 and 22 are shown to be comprised of many individual configurable elements, one of which is identified 24, 26 in each of RIS 20 and 22. The distance between the antennas 18*a*-18*f* and the RIS 20, 22 is identified to be 2λ to 5λ. It is to be understood that this is merely any example of a range of values that could be used as the distance between antennas. The antennas could be closer than 2λ or greater than 5λ. Each antenna is shown to correspond to a subset of configurable elements of the RIS. Each antenna being described as corresponding to a subset of configurable elements of the RIS means that the antenna illuminates the subset of configurable elements of the RIS. For example, antenna 18*a* is shown to correspond to subset of configurable elements 20*a*, antenna 18*c* is shown to correspond to subset of configurable elements 20*c*, and antenna 18*e* is shown to correspond to subset of configurable elements 22*e*. These subsets of configurable elements correspond to the configurable elements that are illuminated by the corresponding antenna when the antenna is transmitting or are illuminating the corresponding antenna when the antenna is receiving. Furthermore, since a subarray has been described as a set of antennas, a group of configurable elements being illuminated by a subarray corresponds to all of, also referred to mathematically as the union of, the sets of configurable elements illuminated by each of the antenna in the subarray. While the cross section of FIG. 1 shows a one dimensional array of antennas and configurable elements in the two RIS, it is understood that the array of antenna and the arrays of configurable elements could be a two dimensional array of antennas and configurable elements.

The first layer of largely spaced apart antenna elements in the antenna array shown in FIG. 1 aids in compensating power dissipation and circuit implementation problems as compared to more closely spaced antennas, especially at high frequency. The second layer comprises one or more RIS that include the closely spaced apart configurable elements.

This document may use antenna and antennal element interchangeable. An antenna array is a set of antenna elements. An antenna subarray may include a set of antennas or antenna elements. Therefore, an antenna array may include a set of antenna subarrays, that each include a set of antennas or antenna elements.

More generally in this disclosure, RIS devices may be referred as a planar array or a linear array of configurable elements. These configurable elements have the ability to redirect a wave/signal that is incident on the planar array or linear array by changing the phase of the wave/signal. The configurable elements are also capable of changing the amplitude, polarization, or even the frequency of the wave/signal. In some planar arrays these changes occur as a result of changing bias voltages that controls the individual configurable elements of the array via a control circuit connected to the planar array or linear array. The control circuit that enables control of the planar array or linear array may be connected to a communications network that base stations and UEs communicating with each other are part of. For example, the network that controls the base station may also provide configuration information to the planar array or linear array. Control methods other than bias voltage control include, but are not limited to, mechanical deformation and phase change materials.

Each part of the RIS (subsets of configurable elements such as 20*a*, 20*c* or 22*e* in FIG. 1) in the second layer is illuminated by one of the antennas in the first layer, i.e. the illuminated RIS part by each antenna can be separated or overlapped with those illuminated by another antenna, or a subarray of antennas in the first layer. The term "illuminated" is used to describe that the antenna, or subarray of antennas, transmits a beam in the direction of the subset of configurable elements. The term "illuminated" may also be used in a reverse direction when the antenna, or subarray of antennas, is receiving a signal, from a UE for instance, with regard to focusing a received beam at the RIS back to the antenna element, or subarray of antennas. The goal of the RIS in the second layer is to attenuate the side-lobes from the antennas, or subarray of antennas, in the first layer and to increase the beamforming gain. The antenna's effective aperture may be in part determined by the RIS physical size. By increasing the inter-antenna spacing (more than 0.5λ), a narrower main beam is obtained, but the beam has more significant side-lobes.

At high frequency, the antenna's effective aperture is small, so many antennas are needed to enlarge the antenna's overall effective aperture and increase the beamforming gain. However, the inter-antenna spacing of 0.5λ is very small at high frequency. Hence, placing many closely spaced antennas is hard to implement because of the proximity of the circuits for each antenna including power amplifiers and phase shifters.

Each antenna element and each RIS element of a subset of configurable elements of the RIS corresponding to the antenna element are in the Fraunhofer far field of each other as the size of the configurable elements of the RIS are about $0.25*\lambda^2$ (quarter of the square of operating wavelength) and the distance between the configurable elements of the RIS is equal or larger than the half wavelength. However, the analog beamforming happens jointly by an antenna element of the subarray antenna array and the corresponding respective subsets of configurable elements of the RIS that are illuminated by the antenna element combined with the analog beamforming of one or more subarrays. Generally speaking, leakage of the antenna beam from the antenna element to other subsets of configurable elements of the RIS adjacent to the subset being illuminated by the antenna element can be ignored as only a small percentage of the antenna beam leaks to the adjacent subset of configurable elements of the RIS. Each subarray and its corresponding RIS elements are in the near field of each other. In antenna applications, the Rayleigh distance that separates near field from far field is defined by $$\frac{2L^2}{\lambda},$$

where L is a largest value of either the maximum linear dimension of the subarray of the AoSA or the maximum linear dimension of a subset of the plurality of configurable elements corresponding to the subarray. The Fraunhofer far field region of an antenna is greater than the Rayleigh distance.

Embodiments of the disclosure use a high density of configurable elements in an RIS and, in comparison to the number of configurable elements in an RIS, substantially fewer antenna elements in the antenna array. The substantially fewer antenna elements in the antenna array enable a larger spacing between the antennas, to simplify the RF and PA circuit design. Then, the side-lobes that result from the increased antenna spacing are compensated by the RIS. The RIS also helps to increase the beamforming gain.

It is noted that use of the expressions "antenna array" and "subarray antenna panel" may be used interchangeably in the present disclosure to refer to the same physical element representation of the first layer or first stage.

Figure 2:
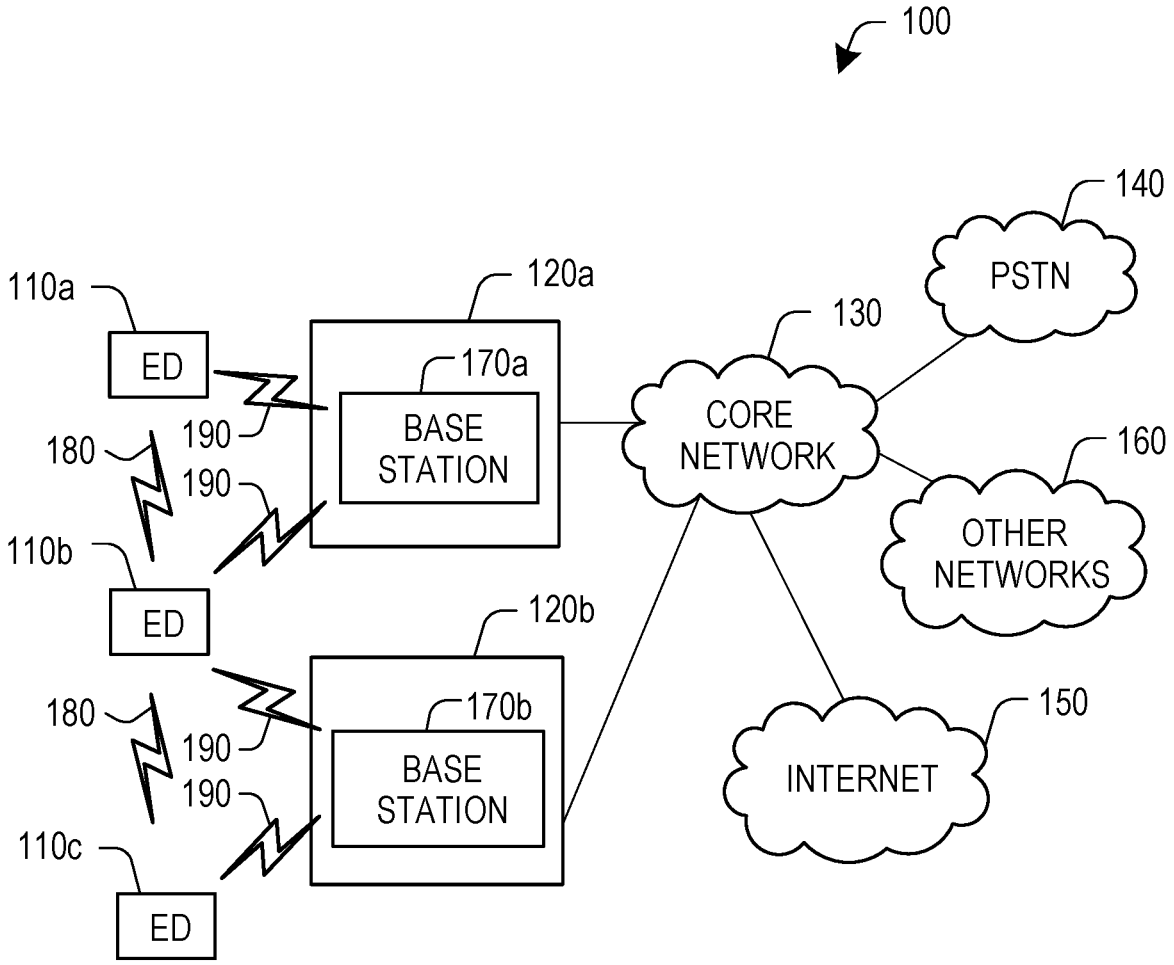
FIG. 2 is a schematic diagram of a communication system in which embodiments of the disclosure may occur.
Figure 3A:
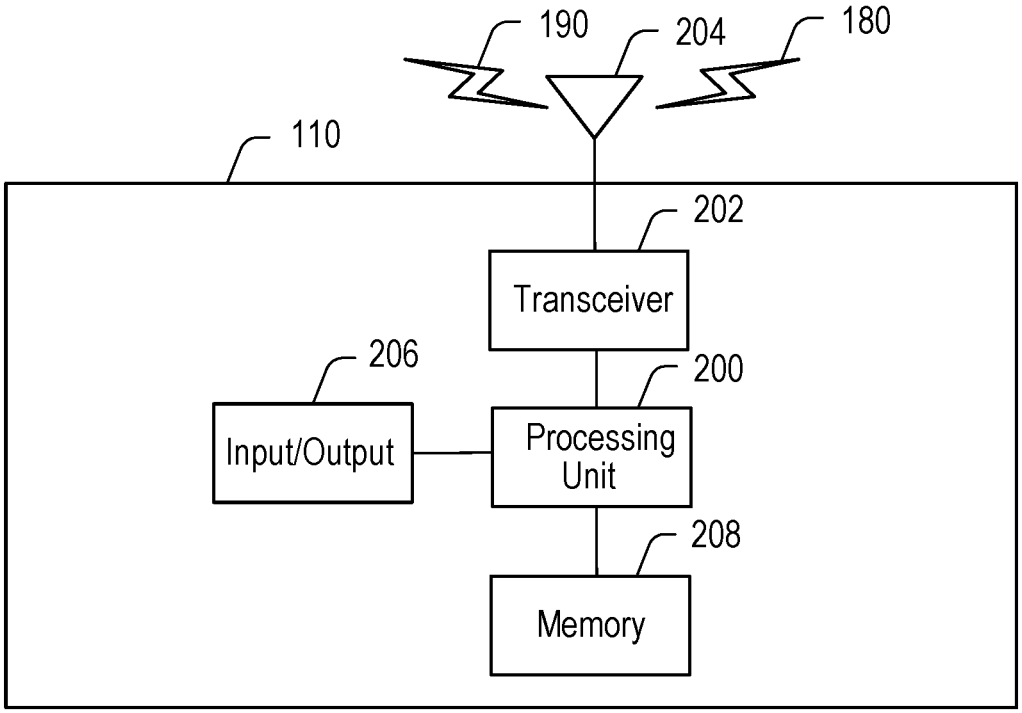
FIGS. 3A and 3B are block diagrams of an example user equipment and base station, respectively.
Figure 3B:
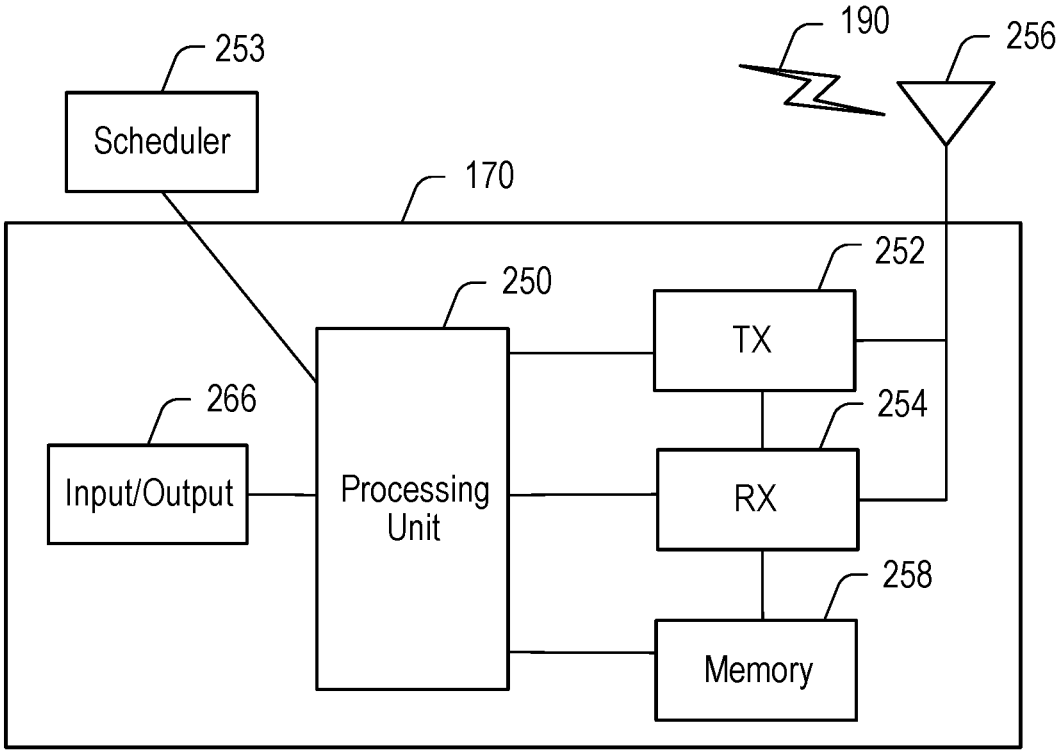

FIGS. 2, 3A, and 3B following below provide context for the network and device that may be in the network and that may implement aspects of the present disclosure.

FIG. 2 illustrates an example communication system 100 in which embodiments of the present disclosure could be implemented. In general, the system 100 enables multiple wireless or wired elements to communicate data and other content. The purpose of the system 100 may be to provide content (voice, data, video, text) via broadcast, narrowcast, user device to user device, etc. The system 100 may operate efficiently by sharing resources such as bandwidth.

In this example, the communication system 100 includes electronic devices (ED) 110*a*-110*c*, radio access networks (RANs) 120*a*-120*b*, a core network 130, a public switched telephone network (PSTN) 140, the Internet 150, and other networks 160. While certain numbers of these components or elements are shown in FIG. 2, any reasonable number of these components or elements may be included in the system 100.

The EDs 110*a*-110*c* are configured to operate, communicate, or both, in the system 100. For example, the EDs 110*a*-110*c* are configured to transmit, receive, or both via wireless communication channels. Each ED 110*a*-110*c* represents any suitable end user device for wireless operation and may include such devices (or may be referred to) as a user equipment/device (UE), wireless transmit/receive unit (WTRU), mobile station, mobile subscriber unit, cellular telephone, station (STA), machine type communication device (MTC), personal digital assistant (PDA), smartphone, laptop, computer, touchpad, wireless sensor, or consumer electronics device.

FIG. 2 illustrates an example communication system 100 in which embodiments of the present disclosure could be implemented. In general, the communication system 100 enables multiple wireless or wired elements to communicate data and other content. The purpose of the communication system 100 may be to provide content (voice, data, video, text) via broadcast, multicast, unicast, user device to user device, etc. The communication system 100 may operate by sharing resources such as bandwidth.

In this example, the communication system 100 includes electronic devices (ED) 110*a*-110*c*, radio access networks (RANs) 120*a*-120*b*, a core network 130, a public switched telephone network (PSTN) 140, the internet 150, and other networks 160. Although certain numbers of these components or elements are shown in FIG. 2, any reasonable number of these components or elements may be included in the communication system 100.

The EDs 110*a*-110*c* are configured to operate, communicate, or both, in the communication system 100. For example, the EDs 110*a*-110*c* are configured to transmit, receive, or both, via wireless or wired communication channels. Each ED 110*a*-110*c* represents any suitable end user device for wireless operation and may include such devices (or may be referred to) as a user equipment/device (UE), wireless transmit/receive unit (WTRU), mobile station, fixed or mobile subscriber unit, cellular telephone, station (STA), machine type communication (MTC) device, personal digital assistant (PDA), smartphone, laptop, computer, tablet, wireless sensor, or consumer electronics device.

In FIG. 2, the RANs 120*a*-120*b* include base stations 170*a*-170*b*, respectively. Each base station 170*a*-170*b* is configured to wirelessly interface with one or more of the EDs 110*a*-110*c* to enable access to any other base station 170*a*-170*b*, the core network 130, the PSTN 140, the internet 150, and/or the other networks 160. For example, the base stations 170*a*-170*b* may include (or be) one or more of several well-known devices, such as a base transceiver station (BTS), a Node-B (NodeB), an evolved NodeB (eNodeB), a Home eNodeB, a gNodeB, a transmission and receive point (TRP), a site controller, an access point (AP), or a wireless router. Any ED 110*a*-110*c* may be alternatively or additionally configured to interface, access, or communicate with any other base station 170*a*-170*b*, the internet 150, the core network 130, the PSTN 140, the other networks 160, or any combination of the preceding.

The EDs 110*a*-110*c* and base stations 170*a*-170*b* are examples of communication equipment that can be configured to implement some or all of the functionality and/or embodiments described herein. In the embodiment shown in FIG. 2, the base station 170*a* forms part of the RAN 120*a*, which may include other base stations, base station controller(s) (BSC), radio network controller(s) (RNC), relay nodes, elements, and/or devices. Any base station 170*a*, 170*b* may be a single element, as shown, or multiple elements, distributed in the corresponding RAN, or otherwise. Also, the base station 170*b* forms part of the RAN 120*b*, which may include other base stations, elements, and/or devices. Each base station 170*a*-170*b* transmits and/or receives wireless signals within a particular geographic region or area, sometimes referred to as a "cell" or "coverage area". A cell may be further divided into cell sectors, and a base station 170*a*-170*b* may, for example, employ multiple transceivers to provide service to multiple sectors. In some embodiments, there may be established pico or femto cells where the radio access technology supports such. In some embodiments, multiple transceivers could be used for each cell, for example using multiple-input multiple-output (MIMO) technology. The number of RAN 120*a*-120*b* shown is exemplary only. Any number of RAN may be contemplated when devising the communication system 100.

The base stations 170*a*-170*b* communicate with one or more of the EDs 110*a*-110*c* over one or more air interfaces 190 using wireless communication links e.g. radio frequency (RF), microwave, infrared (IR), etc. The air interfaces 190 may utilize any suitable radio access technology. For example, the communication system 100 may implement one or more orthogonal or non-orthogonal channel access methods, such as code division multiple access (CDMA), time division multiple access (TDMA), frequency division multiple access (FDMA), orthogonal FDMA (OFDMA), or single-carrier FDMA (SC-FDMA) in the air interfaces 190.

A base station 170*a*-170*b* may implement Universal Mobile Telecommunication System (UMTS) Terrestrial Radio Access (UTRA) to establish an air interface 190 using wideband CDMA (WCDMA). In doing so, the base station 170*a*-170*b* may implement protocols such as High Speed Packet Access (HSPA), Evolved HPSA (HSPA+) optionally including High Speed Downlink Packet Access (HSDPA), High Speed Packet Uplink Access (HSUPA) or both. Alternatively, a base station 170*a*-170*b* may establish an air interface 190 with Evolved UTMS Terrestrial Radio Access (E-UTRA) using LTE, LTE-A, and/or LTE-B. It is contemplated that the communication system 100 may use multiple channel access functionality, including such schemes as described above. Other radio technologies for implementing air interfaces include IEEE 802.11, 802.15, 802.16, CDMA2000, CDMA2000 1×, CDMA2000 EV-DO, IS-2000, IS-95, IS-856, GSM, EDGE, and GERAN. Of course, other multiple access schemes and wireless protocols may be utilized.

The RANs 120*a*-120*b* are in communication with the core network 130 to provide the EDs 110*a*-110*c* with various services such as voice, data, and other services. The RANs 120*a*-120*b* and/or the core network 130 may be in direct or indirect communication with one or more other RANs (not shown), which may or may not be directly served by core network 130, and may or may not employ the same radio access technology as RAN 120*a*, RAN 120*b* or both. The core network 130 may also serve as a gateway access between (i) the RANs 120*a*-120*b* or EDs 110*a*-110*c* or both, and (ii) other networks (such as the PSTN 140, the internet 150, and the other networks 160).

The EDs 110*a*-110*c* communicate with one another over one or more SL air interfaces 180 using wireless communication links e.g. radio frequency (RF), microwave, infrared (IR), etc. The SL air interfaces 180 may utilize any suitable radio access technology, and may be substantially similar to the air interfaces 190 over which the EDs 110*a*-110*c* communication with one or more of the base stations 170*a*-170*c*, or they may be substantially different. For example, the communication system 100 may implement one or more channel access methods, such as code division multiple access (CDMA), time division multiple access (TDMA), frequency division multiple access (FDMA), orthogonal FDMA (OFDMA), or single-carrier FDMA (SC-FDMA) in the SL air interfaces 180. In some embodiments, the SL air interfaces 180 may be, at least in part, implemented over unlicensed spectrum.

In addition, some or all of the EDs 110*a*-110*c* may include functionality for communicating with different wireless networks over different wireless links using different wireless technologies and/or protocols. Instead of wireless communication (or in addition thereto), the EDs may communicate via wired communication channels to a service provider or switch (not shown), and to the internet 150. PSTN 140 may include circuit switched telephone networks for providing plain old telephone service (POTS). Internet 150 may include a network of computers and subnets (intranets) or both, and incorporate protocols, such as internet protocol (IP), transmission control protocol (TCP) and user datagram protocol (UDP). EDs 110*a*-110*c* may be multimode devices capable of operation according to multiple radio access technologies, and incorporate multiple transceivers necessary to support multiple radio access technologies.

The hybrid analog/digital RIS beamforming antennas could be used in the base stations 170*a*, 170*b* and EDs 110*a*, 110*b* and 110*c* shown in FIG. 2.

FIGS. 3A and 3B illustrate example devices that may implement the methods and teachings according to this disclosure. In particular, FIG. 3A illustrates an example ED 110, and FIG. 3B illustrates an example base station 170. These components could be used in the system 100 or in any other suitable system.

As shown in FIG. 3A, the ED 110 includes at least one processing unit 200. The processing unit 200 implements various processing operations of the ED 110. For example, the processing unit 200 could perform signal coding, data processing, power control, input/output processing, or any other functionality enabling the ED 110 to operate in the communication system 100. The processing unit 200 may also be configured to implement some or all of the functionality and/or embodiments described in more detail herein. Each processing unit 200 includes any suitable processing or computing device configured to perform one or more operations. Each processing unit 200 could, for example, include a microprocessor, microcontroller, digital signal processor, field programmable gate array, or application specific integrated circuit.

The ED 110 also includes at least one transceiver 202. The transceiver 202 is configured to modulate data or other content for transmission by at least one antenna or Network Interface Controller (NIC) 204. The transceiver 202 is also configured to demodulate data or other content received by the at least one antenna 204. Each transceiver 202 includes any suitable structure for generating signals for wireless or wired transmission and/or processing signals received wirelessly or by wire. Each antenna 204 includes any suitable structure for transmitting and/or receiving wireless or wired signals. For example the antenna 204 may be a hybrid analog/digital RIS beamforming antennas.

One or multiple transceivers 202 could be used in the ED 110. One or multiple antennas 204 could be used in the ED 110. Although shown as a single functional unit, a transceiver 202 could also be implemented using at least one transmitter and at least one separate receiver.

The ED 110 further includes one or more input/output devices 206 or interfaces (such as a wired interface to the internet 150). The input/output devices 206 permit interaction with a user or other devices in the network. Each input/output device 206 includes any suitable structure for providing information to or receiving information from a user, such as a speaker, microphone, keypad, keyboard, display, or touch screen, including network interface communications.

In addition, the ED 110 includes at least one memory 208. The memory 208 stores instructions and data used, generated, or collected by the ED 110. For example, the memory 208 could store software instructions or modules configured to implement some or all of the functionality and/or embodiments described above and that are executed by the processing unit(s) 200. Each memory 208 includes any suitable volatile and/or non-volatile storage and retrieval device(s). Any suitable type of memory may be used, such as random access memory (RAM), read only memory (ROM), hard disk, optical disc, subscriber identity module (SIM) card, memory stick, secure digital (SD) memory card, and the like.

As shown in FIG. 3B, the base station 170 includes at least one processing unit 250, at least one transmitter 252, at least one receiver 254, one or more antennas 256, at least one memory 258, and one or more input/output devices or interfaces 266. A transceiver, not shown, may be used instead of the transmitter 252 and receiver 254. A scheduler 253 may be coupled to the processing unit 250. The scheduler 253 may be included within or operated separately from the base station 170. The processing unit 250 implements various processing operations of the base station 170, such as signal coding, data processing, power control, input/output processing, or any other functionality. The processing unit 250 can also be configured to implement some or all of the functionality and/or embodiments described in more detail above. Each processing unit 250 includes any suitable processing or computing device configured to perform one or more operations. Each processing unit 250 could, for example, include a microprocessor, microcontroller, digital signal processor, field programmable gate array, or application specific integrated circuit.

Each transmitter 252 includes any suitable structure for generating signals for wireless or wired transmission to one or more EDs or other devices. Each receiver 254 includes any suitable structure for processing signals received wirelessly or by wire from one or more EDs or other devices. Although shown as separate components, at least one transmitter 252 and at least one receiver 254 could be combined into a transceiver. Each antenna 256 includes any suitable structure for transmitting and/or receiving wireless or wired signals. For example the antenna 256 may be a hybrid analog/digital RIS beamforming antennas. Although a common antenna 256 is shown here as being coupled to both the transmitter 252 and the receiver 254, one or more antennas 256 could be coupled to the transmitter(s) 252, and one or more separate antennas 256 could be coupled to the receiver(s) 254. Each memory 258 includes any suitable volatile and/or non-volatile storage and retrieval device(s) such as those described above in connection to the ED 110. The memory 258 stores instructions and data used, generated, or collected by the base station 170. For example, the memory 258 could store software instructions or modules configured to implement some or all of the functionality and/or embodiments described above and that are executed by the processing unit(s) 250.

Each input/output device 266 permits interaction with a user or other devices in the network. Each input/output device 266 includes any suitable structure for providing information to or receiving/providing information from a user, including network interface communications.

Additional details regarding the UEs 110 and the base stations 170 are known to those of skill in the art. As such, these details are omitted here for clarity.

An example implementation of a combined antenna array and RIS will now be described. Whereas FIG. 1 describes a linear antenna and RIS arrays, the presently described embodiment considers a two dimensional design of the hybrid beamforming.

The antenna panel includes a multiple subarray panels of largely spaced apart antenna elements. Largely spaced apart is intended to mean more than the operating wavelength (λ) of the hybrid antenna, for example greater than 1 to 4 times the wavelength. Embodiments in which the antenna elements are each connected to an RF chain are considered to be separately connected. Separately connected means that each RF chain is connected to a separate subset of antennas as shown in the FIG. 1.

In embodiments in which the antenna elements are each connected to all RF chains, the antenna elements are considered to be fully connected. In embodiments in which a subset of the antenna elements is connected to a RF chain, the antenna elements are considered to be partially connected. However, some antennas of this subset can be connected to multiple RF chains.

In an implementation where there are a same number of physically sized subarray antenna panels and RIS panels, each subarray antenna panel having a respective number of antennal elements and each RIS panel having a respective number of configurable elements, each subarray antenna panel illuminates a corresponding RIS panel. While there may be some illumination of adjacent RIS panels by a given subarray panel, a majority of the subarray antenna panel illumination is directed to the corresponding RIS panel. Each RIS panel consists of many closely spaced configurable elements. Closely spaced in this context means the inter-element spacing is 0.5*wavelength or less.

Figure 4:
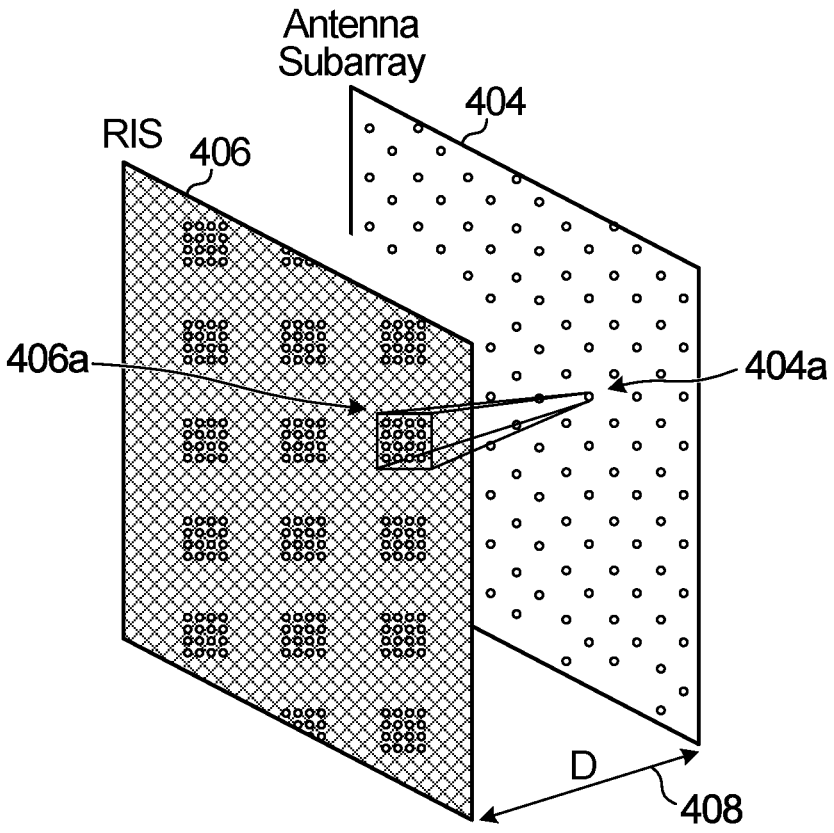
FIG. 4 is a schematic diagram illustrating a combined subarray antenna array and a RIS according to an aspect of the disclosure.

FIG. 4 is an example of a subarray antenna panel 404 (of few elements, largely spaced) in combination with a RIS panel 406. The subarray antenna panel 404 has relatively fewer antenna elements, in comparison to the number of configurable elements in the RIS panel 406 and the antenna elements of the subarray antenna panel 404 are space apart to a larger degree than the configurable elements of the RIS panel 406. Each antenna element emits/radiates a signal that illuminates a subset of RIS configurable elements in front of it. An example of this is shown in terms of antenna element 404*a* of the antenna subarray panel 404 illuminating a plurality of configurable elements 406*a*. Some embodiments may utilize multiple subarray antenna panels arranged in an array, for example a 2×2 array of subarray antenna panels of a type shown in FIG. 4.

The distance between the subarray antenna panel 404 and the RIS panel 406 is D 408. The distance D is chosen to enable (1) a sufficient gain, (2) reduce inter-illumination of same RIS elements from multiple antennas/subarrays and (3) adhere to practical limitations of the RIS, such as, for example, the sensitivity of the material to an incident angle of the signal impinging on the RIS. With reference to the expression "sufficient gain", in some embodiments, this may mean 90% or more of the maximum gain.

While gain may increase with an increasing value of D, the value of D may be limited as a result of the physical size of the transmitter. For small transceivers with closely placed baseband and/or radio frequency antennas, the RIS panel cannot be too far from the antenna elements. For example, at 150 GHz, the wavelength is 2 mm. To achieve five times the wavelength (5Δ), 1 cm of spacing is needed between the RIS panel and the subarray antenna panel in addition to the physical dimensions of the panels and circuitry supporting the hybrid antenna. In addition, if the value of D is too large, each subarray antenna panel could use a set of more directive antenna elements or otherwise the antenna elements may illuminate not only its corresponding part of the RIS panel, but also a neighboring part of the RIS associated with other antenna elements of the subarray. Such inter-illumination may adversely impact the overall beamforming gain and may cause inter-subarray interference impacting the performance of multi-user multiple input multiple output (MIMO). This effect may result in some other techniques being needed to alleviate the interference and improve the gain of the beamforming. For example, if the density of configurable elements of the RIS panel is 64 times (8×8) of the density of the antenna elements of the subarray antenna panel, at four times the wavelength, the antenna pattern of each element should cover a solid angle of 90 degrees width from each side. The angle width would reduce to 52 degrees at 8 times the wavelength.

For some types of material used in the configurable elements of the RIS panels that are sensitive to the incident angle, it is preferable not to make the distance very small as otherwise performance, including factors such as gain, side lobe suppression, radiation efficiency and bandwidth, may adversely be impacted. For example, with a density of configurable elements of the RIS being 64 (8×8) as compared to the density of antenna elements of the subarray antenna panel and the RIS panel and subarray antenna panel being spaced apart at two times the wavelength, the incident angle of the farthest corner of the RIS panel is 70 degrees with respect to the boresight while the center element experiences zero degree incidence angle. The boresight refers to the side of the RIS that is facing the subarray antenna panel. For non-homogeneous materials used in the RIS panel that are sensitive to the incidence angle difference, there may be an adverse impact on the performance gain.

While one RIS panel and one subarray antenna panel are shown in FIG. 4, it is to be understood that a number of smaller RIS panels can focus beams from multiple antenna sub-array panels. Also, a number of smaller RIS panels can focus beams from one antenna sub-array panel or one RIS panel can focus beams from multiple antenna sub-array panels.

Considering the deployment in FIG. 4 that is described above, the hybrid antenna can be more generally described as the subarray antenna panel consisting of a rectangle of size M×N antenna elements that are each separated by Kλ/2, where λ is the wavelength and K is an integer value. The RIS panel in proximity to the subarray antenna panel can be considered to comprise KM×KN configurable elements each separated by λ/2. Although the antenna elements are spaced apart by an amount larger than the wavelength, the RIS panel reduces the side-lobes in the resulting beamforming pattern. The RIS panel is separated by a distance D from the subarray antenna panel surface. Each antenna beam is designed to illuminate the K×K RIS configurable elements on the RIS panel that are directly in front of the antenna element, when the two panels are parallel to one another. In this situation, the antenna beam width in each direction is 2 atan $$\frac{K\lambda}{4D}.$$

For beamforming, and to cover a direction with inclination angles θ, ζ with respect to the two axes of the subarray antenna panel, the antenna elements phase shift between adjacent elements are $$\frac{K\lambda}{2D}\cos\theta \text{ and } \frac{K\lambda}{2D}\cos\zeta,$$

respectively. However, the phase shift at the RIS panel for the (lth,mth) element $$\left(l, m = -\frac{K-1}{2}, \ldots, \frac{K-1}{2}\right)$$

from the center of the set of configurable elements of the RIS associated with the antenna element in the θ, ζ directions is $$\phi_{l,m} = \pi l\cos\theta + \pi m\cos\zeta - \frac{2\pi}{\lambda}\left(\sqrt{\left(\frac{l\lambda}{2}\right)^2 + \left(\frac{m\lambda}{2}\right)^2 + D^2} - D\right)$$

As can be seen from this equation, the phase shift consists of two components that are dependent on the beam direction and on the structure of the RIS, respectively. So, at the time of implementation, the component of the phase shift that relies on the structure of the RIS can be implemented and the component that is based on the beam direction may be implemented dynamically. The above described phase shift is the same for both transmission and reception.

Another possible implementation comprises a two-layer RIS, in which one layer is fixed and performs beam focus and the other layer is configurable to perform beam steering and possibly fixing errors in the focusing step.

The effective antenna aperture of a set of antenna elements is proportional to the number of antenna elements, which in the above described case is N×M. With the addition of the RIS panel including KM×KN elements in front of the antenna panel, this will increase to N×M×$K^2$. This gain result is the same gain as if only a subarray of antenna elements were used having NK×MK elements and no RIS panel in proximity.

While the gain of this arrangement is on the order of $K^2$, the actual result is slightly less than that. The reduction in the gain from $K^2$ occurs for several reasons. Each antenna element is considered to have a pattern that illuminates the group of configurable elements in the RIS panel in front of it. This means that the antenna element has a particular directivity. The configurable elements of the RIS that are not directly in front of the antenna element receive a beam from the antenna element at an angle, effectively reducing the overall beam gain. There is also a beam steering loss that is caused by the RIS. When the RIS panel is close to the subarray antenna panel, the beam of the antenna element is not directive, but the configurable elements at the edge of the RIS panel have an acute angle towards the antenna element. When the RIS panel and subarray antenna panel are further apart, the RIS elements see antenna element directly, but the original antenna element beam is directive.

The gain of the RIS panel is compared to a system where a same number of antenna elements (i.e. M×N), but without the RIS, are used. If the gain to the same system with the same number of antenna elements while covering the same solid angle as the combined RIS/antenna panels are compared to one another, then the antenna element are not considered to have a pattern that illuminates a group of configurable elements in the RIS panel in front of it. As a particular example, the following section provides a description of a potential loss caused by the configurable elements of the RIS panel near the edge of the antenna element beam. The focus here is on the beam at the boresight and hence $$\alpha_{out} = \beta_{out} = \frac{\pi}{2}$$

and $\zeta_{out}=0$. The parameters α and β are inclination of the incident angle for the two axes (x and y axis) of the RIS panel and ζ is the incident angle with respect to the boresight.

The antenna signal amplitude (amp) is proportional to $$amp(x, y) = A\sqrt{\cos\zeta_{in}}\,\mathrm{sinc}\left(\frac{a}{\lambda}\cos\alpha_{in}\right)\left(\frac{b}{\lambda}\cos\beta_{in}\right)$$

Where sinc is the sinc function, i.e., $$inc(x) = \frac{\sin(\pi x)}{\pi x};\ a = b = \frac{\lambda}{2}$$

are dimensions of one RIS configurable element and A is the amplitude of the signal received at a configurable element at the center RIS panel. For an element that is at location (x, y) with respect to the configurable element at the center RIS panel, $$\cos\alpha_{in} = \frac{x}{\sqrt{x^2+y^2+D^2}},$$

$$\cos\beta_{in} = \frac{y}{\sqrt{x^2+y^2+D^2}},\ \cos\zeta_{in} = \frac{D}{\sqrt{x^2+y^2+D^2}},$$

where D is the spacing between the RIS panel and the subarray antenna panel.

When the RIS spacing is half the wavelength, the total amplitude at the receive antenna is determined by $$G = \left(\sum_{m=-\frac{k-1}{2}}^{\frac{k-1}{2}}\sum_{n=-\frac{k-1}{2}}^{\frac{k-1}{2}} amp\left(\frac{m\lambda}{2}, \frac{n\lambda}{2}\right)\right)^2,$$

where k is an integer value.

For a beam that comes from a different direction than the boresight, the amplitude is written as $$amp(x, y) = A\sqrt{\cos\zeta_{out}}\sqrt{\cos\zeta_{in}}\,\mathrm{sinc}\left(\frac{a}{\lambda}(\cos\alpha_{in} - \cos\alpha_{out})\right)\left(\frac{b}{\lambda}(\cos\beta_{in} - \cos\beta_{out})\right)$$

In the above equation, $\sqrt{\cos\zeta_{out}}$ reflects the effective surface from beam's point of view and hence is applicable with or without the RIS panel and as a result may be ignored in the RIS effective gain.

In the above discussion it is assumed that the power radiation by the antenna element is uniform at all the configurable elements of the RIS. In the case of other beam patterns, this should be factored into calculation of the gain of RIS. For example, the amplitude at each element due to the flat beam of the antenna element subarray can be written as $$A = \frac{1}{\sqrt{\sum_{m=-\frac{k-1}{2}}^{\frac{k-1}{2}}\sum_{n=-\frac{k-1}{2}}^{\frac{k-1}{2}}\cos\zeta_{in}}}$$

Figure 5:
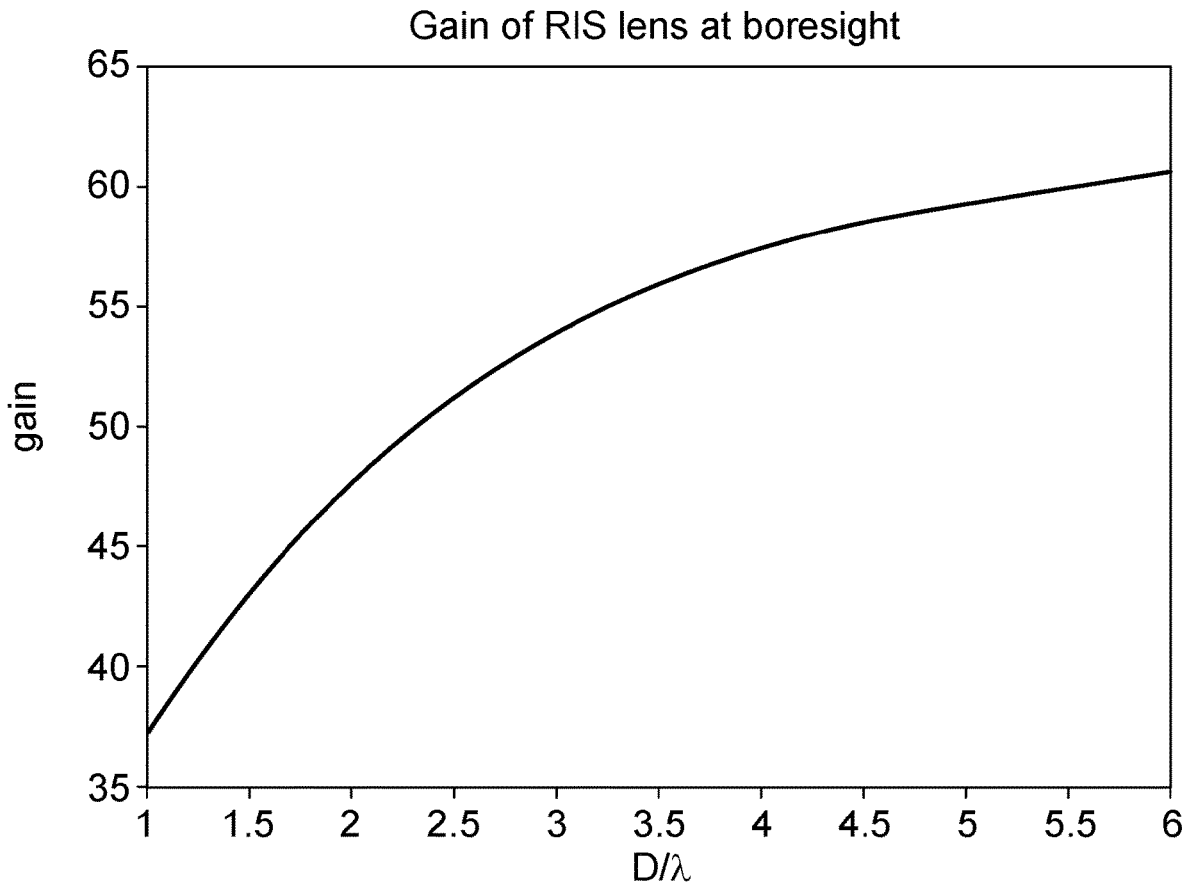
FIG. 5 is a graphical plot illustrating gain of the combined hybrid subarray antenna array and RIS for varying separation of the subarray antenna array and RIS according to an aspect of the disclosure.

FIG. 5 shows a graphical plot of simulated gain versus a distance of the RIS panel from antenna panel (D) in terms of wavelength (λ) for the hybrid combined RIS/subarray antenna system in which N=M=K=8 for the boresight direction. The gain incorporates both the RIS gain and the directivity of the antenna element. As it can be seen in FIG. 5, the RIS gain approaches a maximum value of 64 as the distance between the two panels increases. It achieves 90% of the maximum value of 64 (i.e. 60.8) at around 4 times the wavelength, which is 8 mm at 150 GHz. This plot does not account for leakage of the signal from one antenna element to a subset of configurable elements of the RIS associated with another element.

It should be understood that in this scenario, the beam at each antenna element is set to illuminate the subset of configurable elements of the RIS directly in front of it. However, the effective beam can cover any direction in front of the RIS.

The hybrid combined RIS/subarray antenna system described above combines the beam from antenna elements in the subarray antenna panel and the beam of the configurable elements from the RIS panel.

Since, the separation of the antenna elements is much larger than the wavelength (i.e. a separation distance of $$\frac{K\lambda}{2}),$$

the antenna elements each generate very narrow beams with many side-lobes. For large values of K, the width of the beam at the boresight are in the order of $$\frac{1}{KM}$$

in radians $$(\frac{1}{NK}$$

in the other direction) and the side-lobes at the boresight are separated by $$\frac{2}{K}$$

radians. The beams generated by the respective subsets of configurable elements of the RIS panel associated with the antenna elements each have no side-lobes but a width on the order of $$\frac{1}{K}$$

radians. The combined set of beams from all of the subsets of configurable elements of the RIS panel has negligible side-lobes and a width of the order of $$\frac{1}{MK} \text{ and } \frac{1}{NK}$$

in the two directions.

To make sure that the combined beam is directly pointed at the target transmitter/receiver, the combined beam at the node having the integrated subarray antenna panel and RIS should be known within the accuracy of the corresponding beam. While, the RIS panel is more tolerant with respect to the angle of arrival (AoA) and/or the angle of departure (AoD) estimation because the beam is relatively wider, the beam at the antenna panel should be more accurate. To illustrate this concept, an example is provided.

A target beam width is set to be 3 degrees, which results in an overall solid angle of 2.75 mstradian, or an antenna directivity of 4583. That requires the MK and NK values to be on the order of approximately 60. That means that around 3600 configurable elements for the RIS panel are required to accommodate this beam. To facilitate such a narrow beam with only antenna elements is impractical. However, one can set the parameters M=N=8 and K=8, to enable such a narrow beam. In this case, only 64 antenna elements are required in the subarray antenna panel and the antenna elements are separated by 4λ, which at 150 GHz is 8 mm. The subarray antenna panel is of size 6.4×6.4 $cm^2$. The RIS panel consists of 4096 elements, spaced apart by λ/2 that occupy an equivalent surface area as the subarray antenna panel.

In the above example, the beam generated by the subarray antenna panel is as narrow as 3 degrees but it has multiple strong side-lobes which in some cases are stronger than the main lobe itself, if the target beam does not directly sit in the boresight. The beam generated by the RIS panel is much wider and around 20 degrees wide, but with no side lobes. The main function of the RIS panel is to attenuate the side lobes created by the large separation of elements in the antenna panel.

As a result, the channel estimation accuracy at the RIS panel is not very sensitive while the channel knowledge at the antenna elements is sensitive. In order to alleviate sensitivity to channel estimation and channel aging, the beam processed by the subarray can be widened at the expense of lower subarray gain from a maximum value of MN.

FIGS. 6A, 6B, 6C, 7A, 7B, 7C, 8A, 8B, 8C are simulated graphical plots showing beam pattern power (dB) versus beam inclination in degrees for three different beam steering scenarios. For each beam steering scenario, there is a simulated plot for the response of only the subarray antenna panel, a simulated plot for the response of only the RIS panel and a simulated plot for the combined response of the subarray antenna panel and the RIS panel. The values of M=N=K are equal to 8 and the distance between the two panels is 4λ, which is 8 mm at 150 GHz.

Figure 6A:
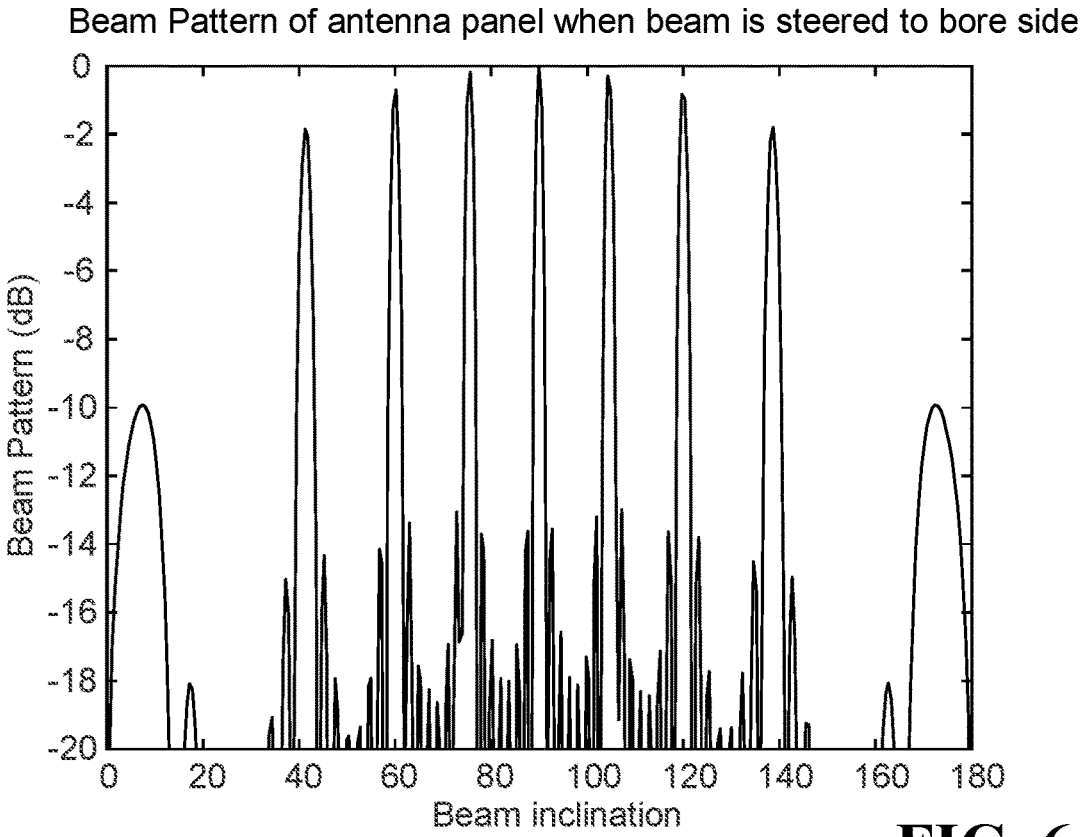
FIGS. 6A, 6B and 6C are graphical plots illustrating beam pattern strength versus beam inclination for the subarray antenna, the RIS and the combined hybrid subarray antenna and RIS together targeted for a user at 0 degree inclination.
Figure 6B:
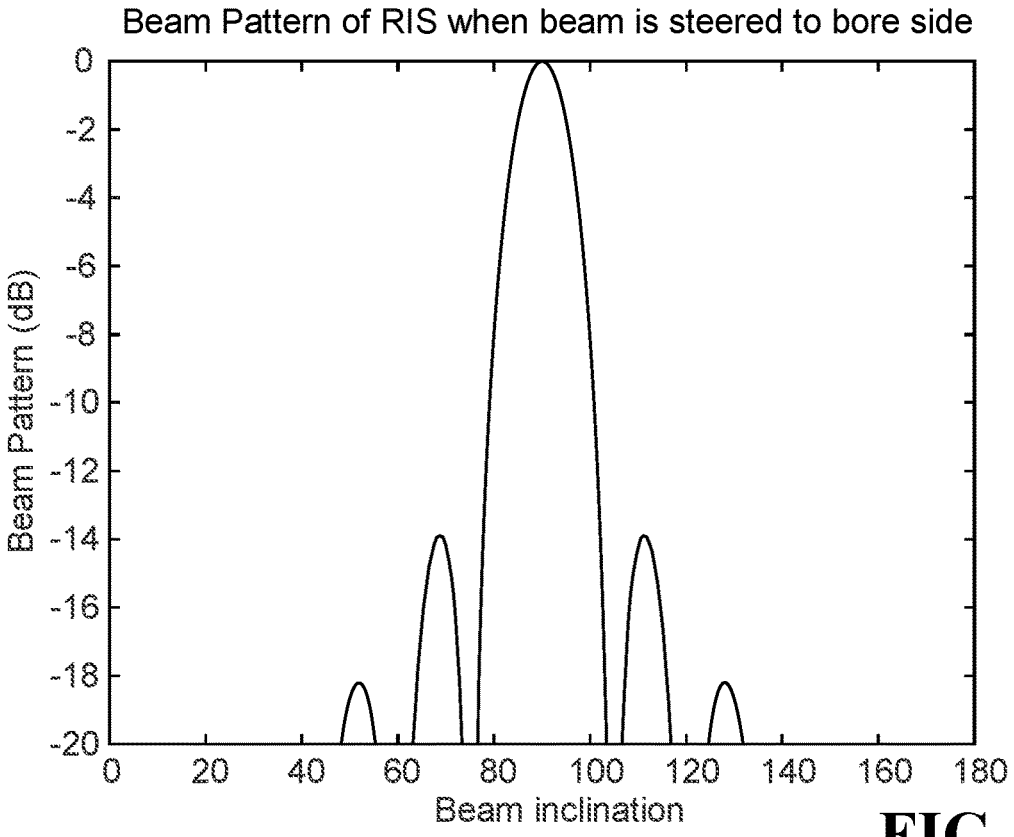
Figure 6C:
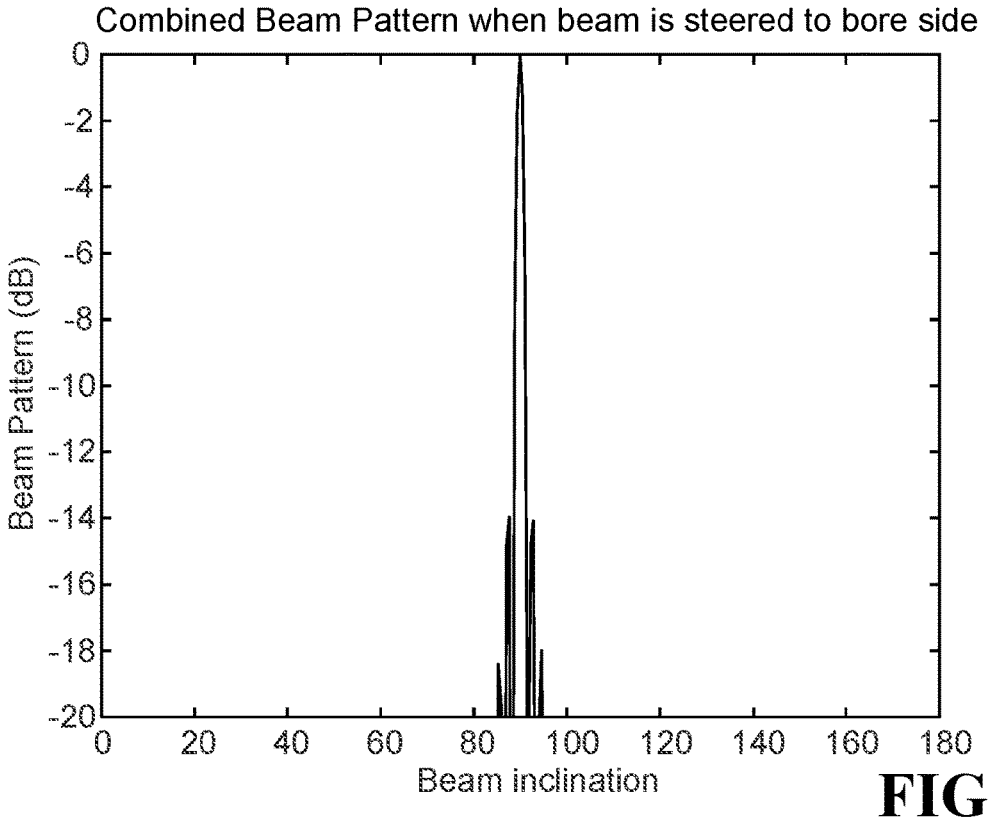

FIG. 6A is a simulated plot for the response of the subarray antenna panel with a main beam at 90 degrees inclination and large side-lobes at approximately 42, 60, 75, 105, 120 and 138 degrees and several other smaller side-lobes. FIG. 6B is a simulated plot for the response of the RIS panel with a wide main beam at 90 degrees inclination and much smaller side-lobes at approximately 55, 70, 110, and 127 degrees. FIG. 6C is a simulated plot for the response of the combined subarray antenna panel and the RIS panel with a narrow main beam at 90 degrees inclination because the side-lobes of the subarray antenna panel are suppressed.

Figure 7A:
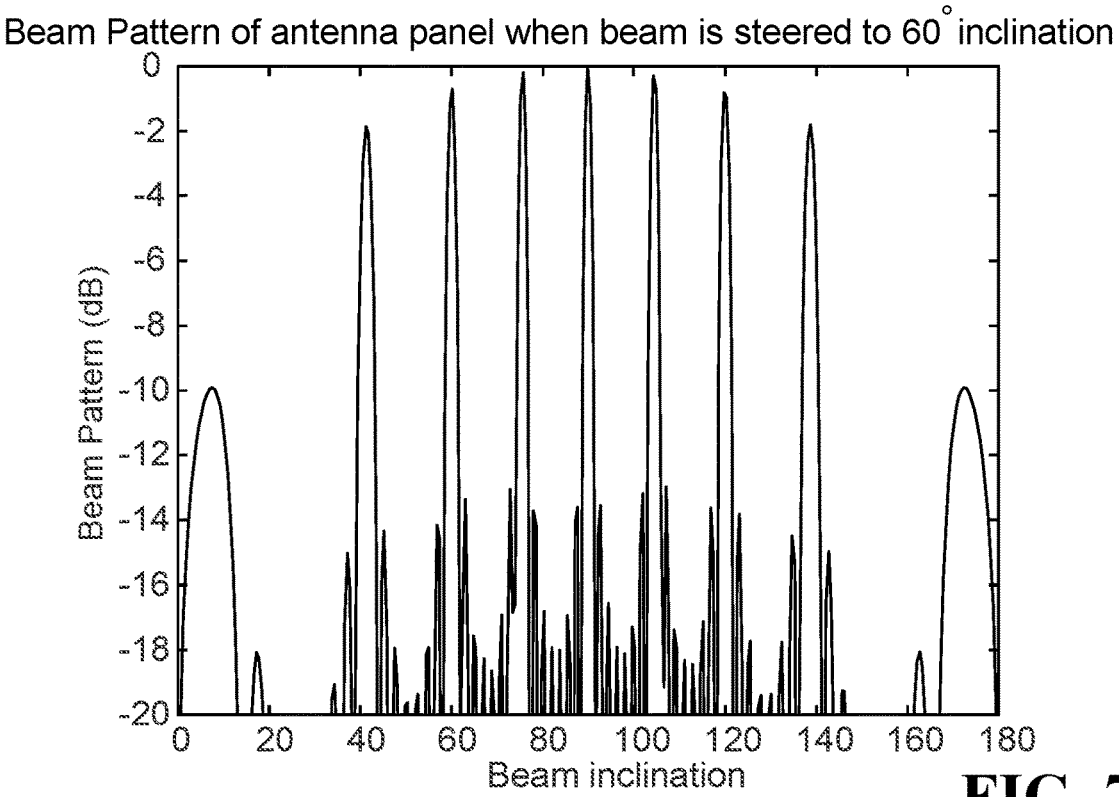
FIGS. 7A, 7B and 7C are graphical plots illustrating beam pattern strength versus beam inclination for the subarray antenna, the RIS and the combined hybrid subarray antenna and RIS together targeted for a user at 60 degree inclination.
Figure 7B:
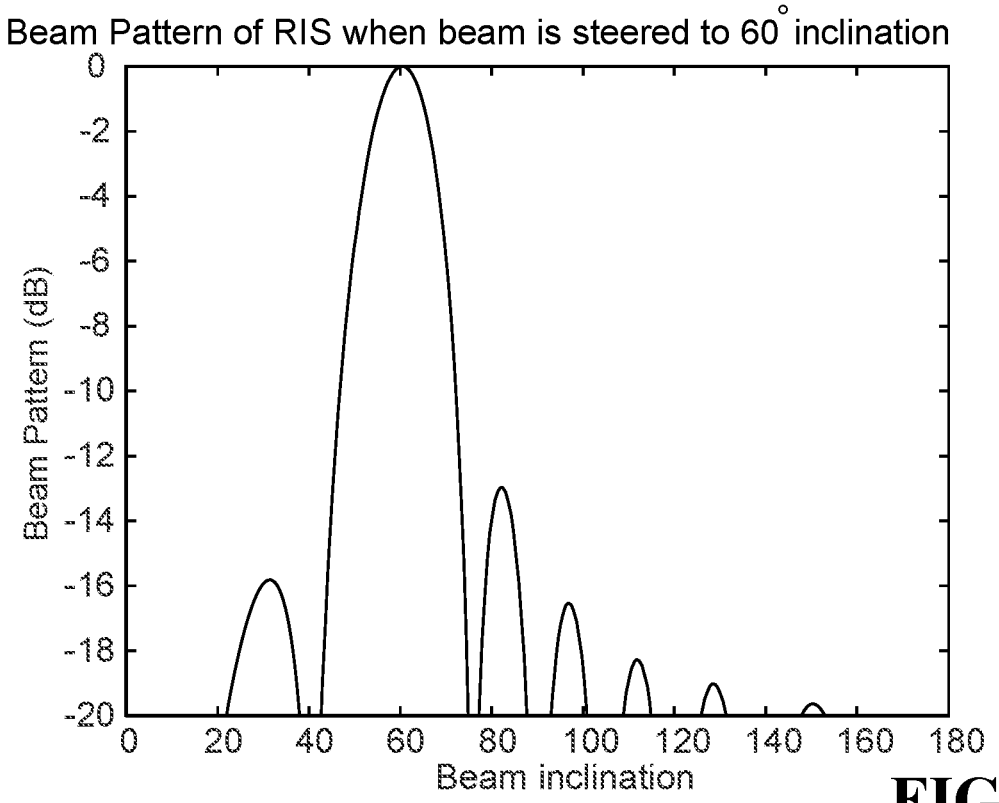
Figure 7C:
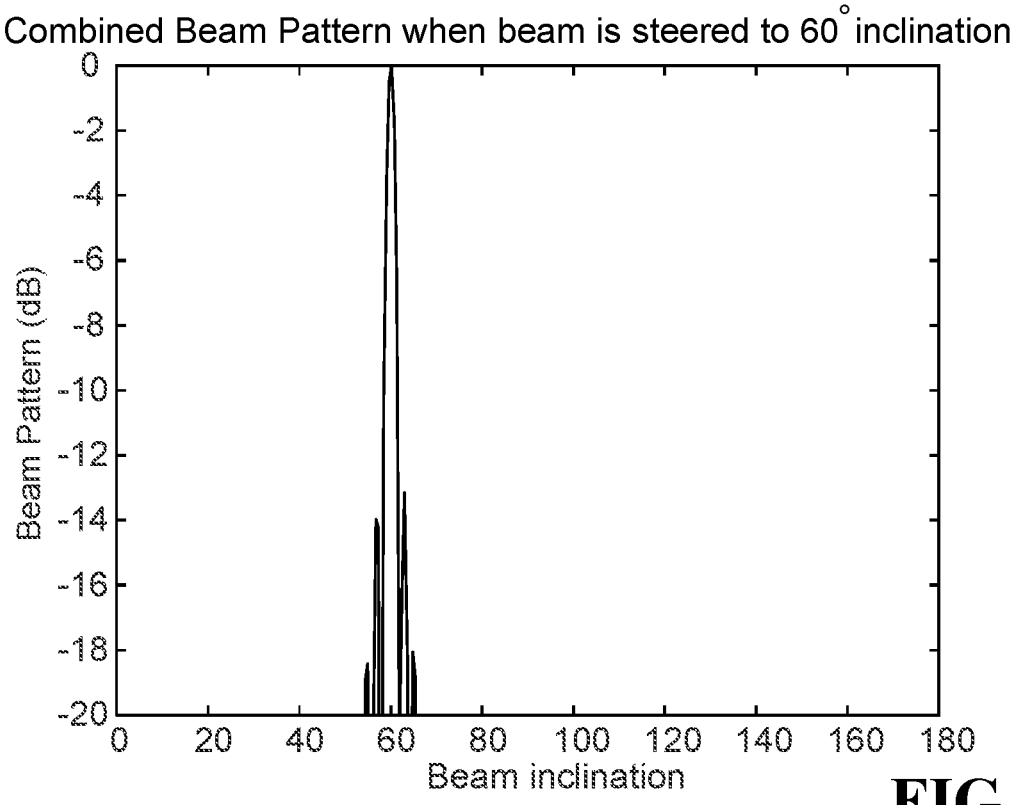

FIG. 7A is a simulated plot for the response of the subarray antenna panel with a main beam at 60 degrees inclination and large side-lobes at approximately 42, 60, 75, 90, 105, 120 and 138 degrees and several other smaller side-lobes. FIG. 7B is a simulated plot for the response of the RIS panel with a wide main beam at 60 degrees inclination and much smaller side-lobes at approximately 30, 82, 96, and 113 degrees and several other smaller side-lobes. FIG. 7C is a simulated plot for the response of the combined subarray antenna panel and the RIS panel with a narrow main beam at 60 degrees inclination because the side-lobes of the subarray antenna panel are suppressed.

Figure 8A:
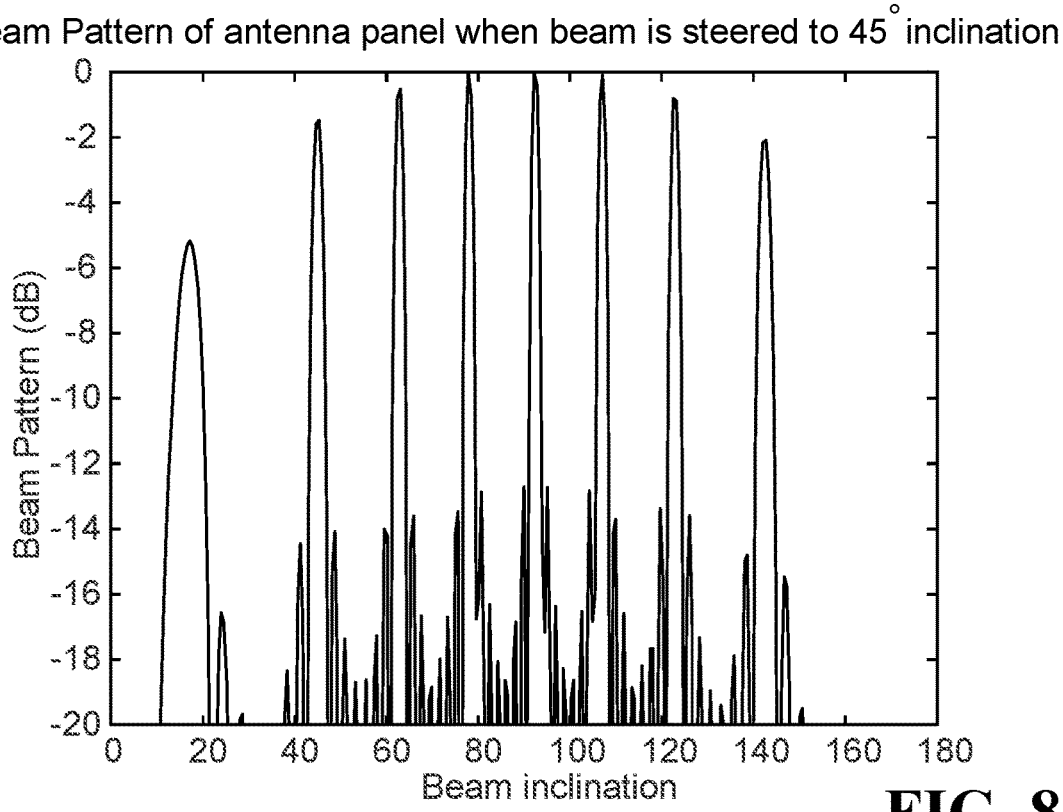
FIGS. 8A, 8B and 8C are graphical plots illustrating beam pattern strength versus beam inclination for the subarray antenna, the RIS and the combined hybrid subarray antenna and RIS together targeted for a user at 45 degree inclination.
Figure 8B:
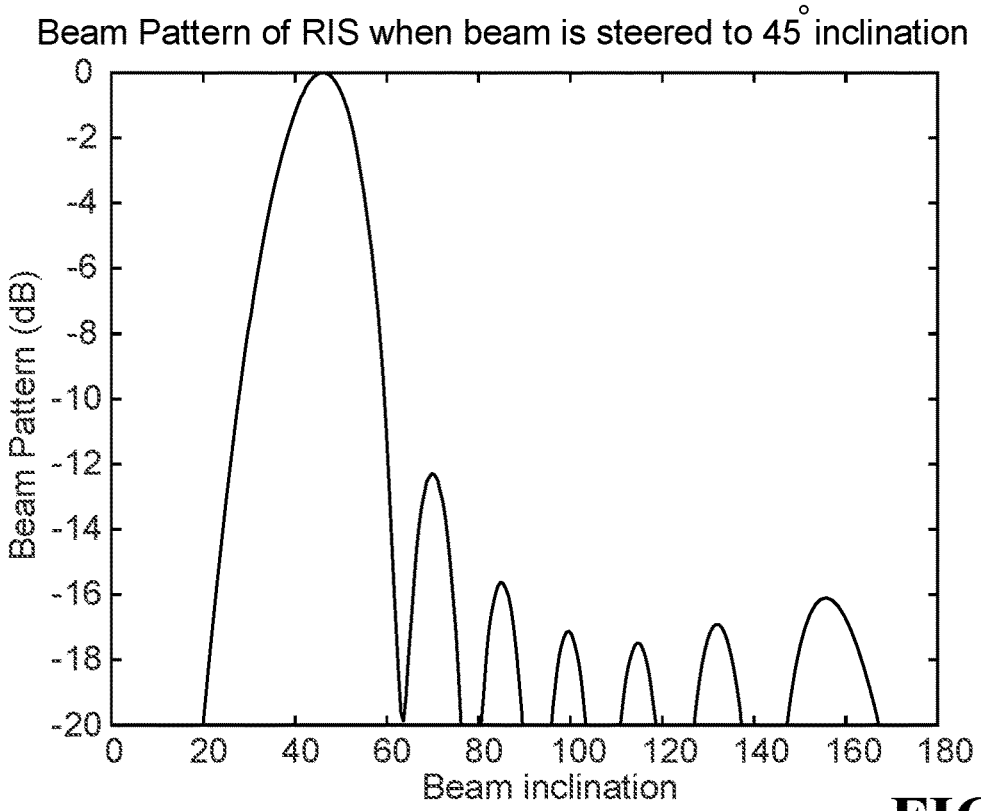
Figure 8C:
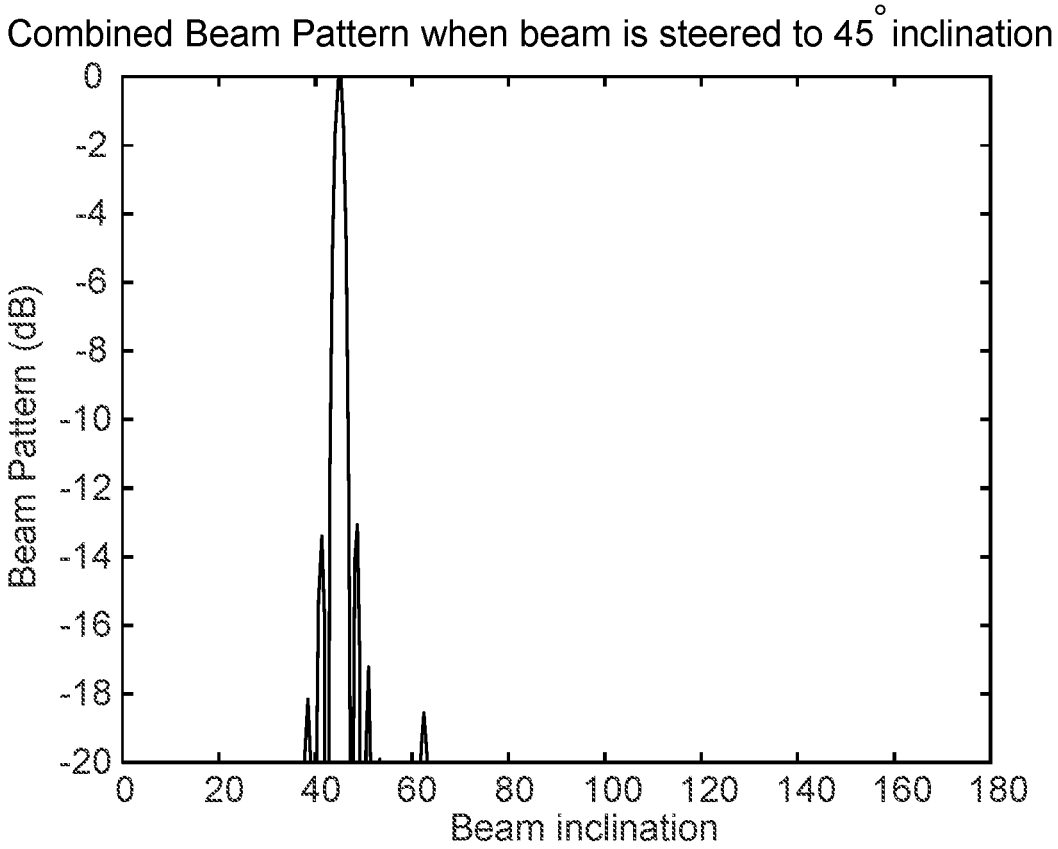

FIG. 8A is a simulated plot for the response of the subarray antenna panel with a main beam at 45 degrees inclination and large side-lobes at approximately 63, 79, 93, 108, 122 and 142 degrees and several other small side-lobes. FIG. 8B is a simulated plot for the response of the RIS panel with a wide main beam at 45 degrees inclination and much smaller side-lobes at approximately 70, 85, 100, 117, 131 and 158 degrees. FIG. 8C is a simulated plot for the response of the combined subarray antenna panel and the RIS panel with a narrow main beam at 45 degrees inclination because the side-lobes of the subarray antenna panel are suppressed.

In some embodiments, the proposed hybrid digital-analog-RIS beamforming can be implemented by a circuitry that allows large space among adjacent antenna elements.

At higher frequencies inter-antenna element spacing of 0.5λ results in a very small footprint of antennas in the subarray antenna panel causing the antenna elements to be very closely spaced. Such closely spaced antennas lead to higher complexity when implementing a power amplifier and a phase shifter behind each antenna element. This problem can be addressed by aspects of the present application by spacing apart antenna elements and using a RIS in proximity the spaced apart antenna elements to create a hybrid combined RIS/subarray antenna system. This arrangement enables more space for power amplifiers and phase shifters implementation and reduces the number of power amplifiers and phase shifters if fewer antenna elements are used.

The RIS panel deployment in combination with the subarray antenna panel compensates the side-lobe resulting from the large spacing of the antenna elements and provides additional beamforming gain to either increase the gain (if the same number of antennas used) or attenuate the gain reduction resulting from a reduced number of antenna elements. The configurable elements in the RIS do not need power amplifiers. The configurable elements in the RIS only need a bias voltage (or some other control mechanism) to shift the phase of an incident signal.

Some embodiments of the disclosure provide large beamforming gain with few marginal side-lobes as the side-lobes are compensated via RIS integration with the largely spaced antennas.

In some embodiments, the antenna element pattern on the subarray antenna panel and the configurable element pattern of the RIS panel are both uniform with different densities and each antenna element illuminates a subset of configurable elements. In some embodiments there may be overlapping of an antenna element to adjacent subsets of configurable elements of the RIS.

In some embodiments, each subsection of configurable elements of the RIS can be illuminated by two antenna elements with different polarization. The two antenna elements are capable of having roughly the same illumination subsections of configurable elements.

In some embodiments, the antenna elements are localized in several antenna element clusters. For example, four antenna elements may be next to each other in a cluster with half a wavelength spacing between them, while the clusters are separated from one another by several wavelengths. Antenna elements illuminating a same subset of configurable elements of the RIS may be connected to the same RF chains and analog circuits or connected to different RF chains and analog circuits.

In some embodiments, the RIS is a single RIS component. In some embodiments, the RIS is multiple separate components. When the RIS is multiple components being used together, the multiple components may span a same plane in a same direction, such that the multiple components are co-planar, or in different directions, such that the multiple components form a three dimensional shape, i.e. a cylinder or hemisphere.

While the example described above in FIG. 4 considers a same size for the RIS panel and antenna subarray panel, the general inventive concept should not be limited to this idea. For example, in one alternative embodiment, the antenna array has a hemispherical shape in front of the RIS. In another embodiment, the antenna array panel is located to one the side of the RIS.

Figure 9:
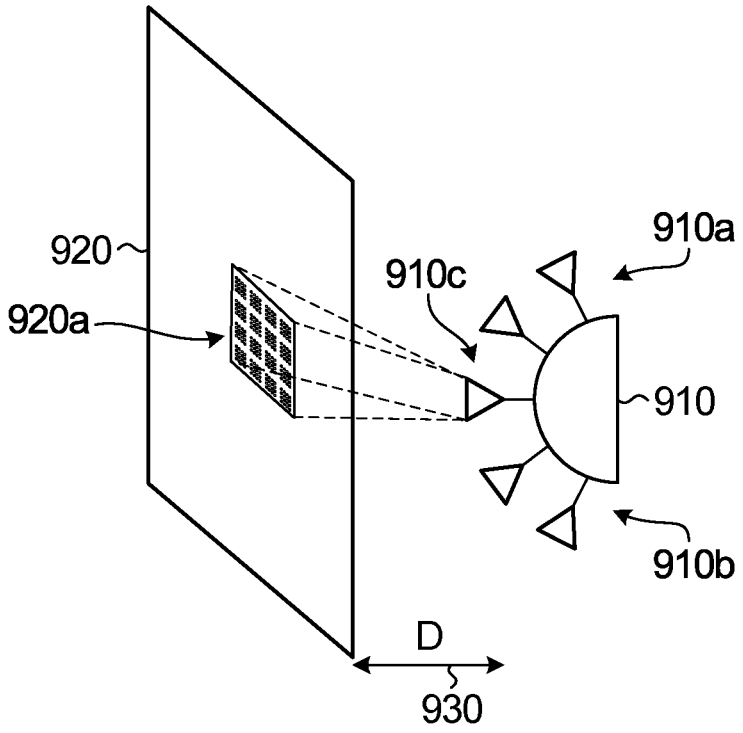
FIG. 9 is a schematic diagram illustrating a combined hemispherical subarray antenna array and a RIS according to an aspect of the disclosure.

FIG. 9 illustrates an example of a hemispherical shaped antenna array. FIG. 9 shows a subarray antenna array 910 that has multiple antenna elements 910*a*, 910*b*, 910*c* on a hemispherical surface. The subarray antenna array 910 is shown here in cross section, so only a plane including five antenna elements is shown. It is to be understood that in this example antenna elements are intended to be arranged on a three dimensional hemispherical surface. A RIS panel 920 with a dense array of configurable elements is spaced apart from the subarray antenna panel 910 by a distance D 930. In some embodiments, D 930 is the shortest separation distance between the RIS panel 920 and the center of the hemispherical antenna array 910. In such an arrangement, the antenna elements uniformly illuminate different subsets of the configurable elements of the RIS panel. An example of this is shown in terms of antenna element 910*c* of the antenna subarray panel 910 illuminating a plurality (4×4) of configurable elements 920*a*. Once again, a subarray may be considered to be a set of antenna elements. Some embodiments may include multiple hemispherical antenna subarrays illuminating respective RIS panels.

In an example, illustrated with particular values of antenna elements and RIS configurable elements that are not intended to limit the more general concept, there may be an array of 8×8 antenna elements separated by λ/2 over the surface of the hemisphere. The RIS panel 920 on a flat plane may be a dense group of configurable elements. In the particular example being described in conjunction with the 8×8 antenna element hemispherical array 910, the RIS panel 920 may include a 64×64 panel of configurable elements separated by λ/2. This would result in a 6.4×6.4 $cm^2$ panel at the operating frequency of 150 GHz. If the value of D was approximately 10-20λ, this would result in a separation of 4-8 cm. In this arrangement, the antenna elements uniformly illuminate different 8×8 subsets of the configurable elements of the RIS panel.

The RIS panel can be configured such that the RIS acts a transmissive element and radiation leaving the antenna panel passes through the RIS panel travelling away from the antenna panel during transmission or radiation arriving at the antenna panel passes through the RIS panel travelling to the antenna panel during reception.

The RIS panel can be configured such that the RIS acts a reflective element and radiation leaving the antenna panel is reflected off the RIS travelling away from the antenna panel or radiation arriving at the antenna panel is reflected off the RIS panels travelling to the antenna panel during reception. In some embodiment there may be some radiation shadow due to the antenna panel. For example, the effective shadowing ratio may be 1.6% at boresight.

Figure 10:
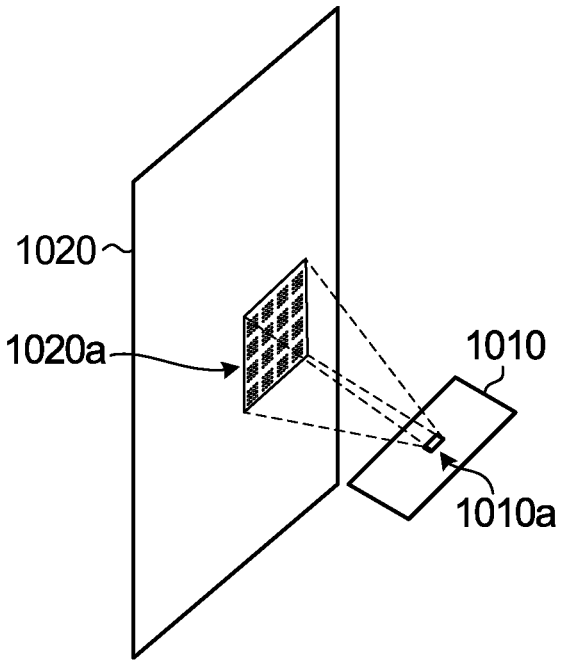
FIG. 10 is a schematic diagram illustrating a combined subarray antenna array and a RIS, wherein the subarray antenna array is not parallel to the RIS, according to an aspect of the disclosure.

Another implementation that could be used with the hybrid beamforming methodology described herein using a subarray antenna array and a RIS is shown in FIG. 10. FIG. 10 shows a subarray antenna panel 1010 that has multiple antenna elements, only one shown 1010*a*, on a planar surface. A RIS panel 1020 with a dense array of configurable elements, a subset of such configurable elements shown as 1020*a*, is spaced apart from the subarray antenna panel 1010. The subarray antenna panel 1010 is shown to be positioned on one side of the RIS panel 1020, so the subarray antenna panel 1010 is not necessarily parallel to the RIS panel as described above with respect to FIGS. 1 and 4. Once again, a subarray may be considered to be a set of antenna elements.

In such an arrangement, the antenna elements uniformly illuminate different subsets of the configurable elements of the RIS panel. An example of this is shown in terms of antenna element 1010*c* of the antenna subarray panel 1010 illuminating a plurality (4×4) of configurable elements 1020*a*.

The various antenna elements of the subarray antenna panel 1010 are spaced apart from subsets of the configurable elements by different distances D due to the arrangement of the subarray antenna panel 1010 and the RIS panel 1020. For example, an antenna element that is in the corner of the subarray antenna panel 1010 that is closest to the RIS panel 1020 would have a very small distance D, if the antenna element was illuminating a subset of configurable elements of the RIS panel 1020 in the corner closet to the subarray antenna panel 1010. Conversely, the distance D between an antenna element that is in the corner of the subarray antenna panel 1010 that is furthest to the RIS panel 1020 and a subset of configurable elements of the RIS panel 1020 in the corner furthest to the subarray antenna panel 1010, will be a large distance D.

In an example, illustrated with particular values of antenna elements and RIS configurable elements that are not intended to limit the more general concept, the subarray antenna panel 1010 may be an array of 8×8 antenna elements separated by λ/2 over the surface of the planar surface. At an operating frequency of 150 GHz. This may cover a surface of approximately 8×8 $mm^2$. In the particular example being described in conjunction with the 8×8 antenna element, the RIS panel may include a 64×64 panel of configurable elements separated by λ/2. This would result in a 6.4×6.4 $cm^2$ panel at the operating frequency of 150 GHz. Small antenna panel per sub-array (e.g. flat). E.g. 8×8 elements separated by λ/2 (8×8 $mm^2$).

In the above described example, the antenna elements uniformly illuminate different 8×8 subsets of the configurable elements of the RIS panel.

The RIS panel can be configured such that the RIS acts a transmissive element and radiation leaving the antenna panels passes through the RIS panels travelling away from the antenna panels during transmission or radiation arriving at the antenna panels passes through the RIS panels travelling to the antenna panels during reception.

The RIS panel can be configured such that the RIS acts a reflective element and radiation leaving the antenna panels is reflected off the RIS travelling away from the antenna panels or radiation arriving at the antenna panels is reflected off the RIS panels travelling to the antenna panels during reception. In some embodiment there may be some radiation shadow due to the antenna elements. For example, the effective shadowing ratio may be 1.6% at boresight.

Embodiments such as shown on FIGS. 9 and 10 provide a flexible deployment of the hybrid beamforming methodology.

Some embodiments of implementations such as shown on FIGS. 9 and 10 may enable reducing a radiation shadow when the RIS reflects the signals back to towards the antennas. With the designs in FIGS. 9 and 10, a shadow for the reflected radiation is reduced, especially in the case of FIG. 10, as the subarray antenna array is off to the side of the RIS panel.

Figure 11:
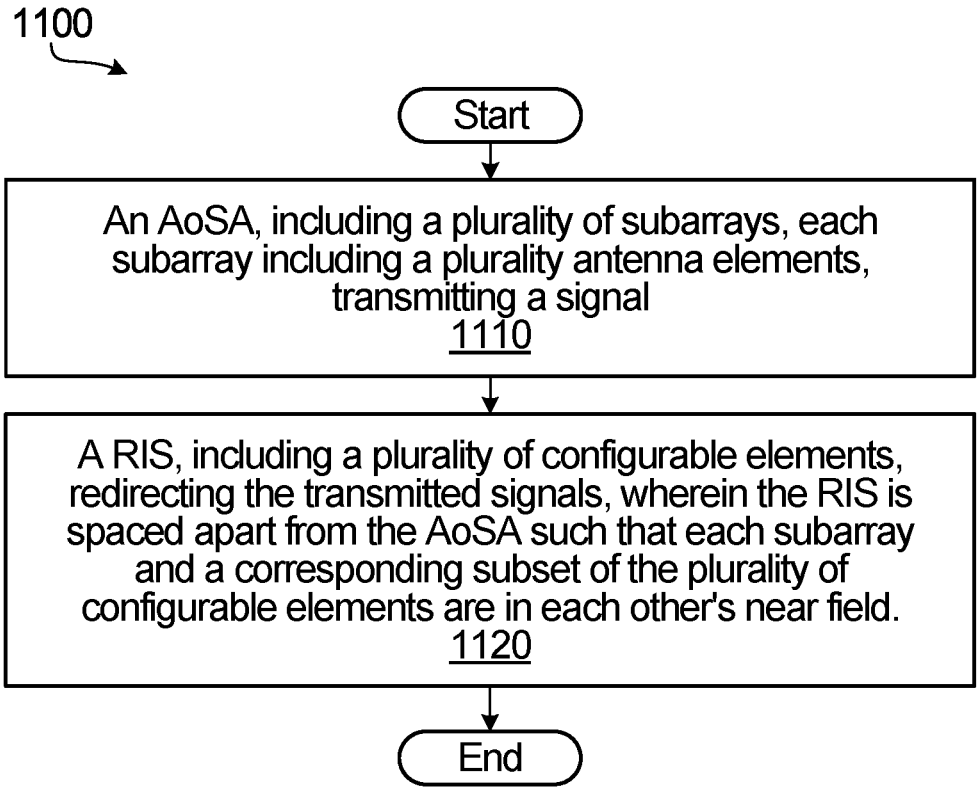
FIG. 11 is a flow chart illustrating a method for transmitting a signal using a combined subarray antenna array and RIS according to an aspect of the application.

FIG. 11 is an example flow diagram 1100 that describes a method for an antenna that is transmitting using the subarray antenna array and RIS as described in various embodiments above.

The method involves an array of subarrays (AoSA), including a plurality of subarrays, each subarray including a plurality of antenna elements, transmitting 1110 a signal. Another step involves a reconfigurable intelligent surface (RIS), including a plurality of configurable elements, redirecting 1120 the transmitted signals. The RIS is spaced apart from the AoSA such that each subarray and a corresponding subset of the plurality of configurable elements are in each other's near field. The near field is less than a distance determined in accordance with a maximum linear dimension of a subarray of the AoSA or a subset of the plurality of configurable elements corresponding to the subarray and a frequency that belongs to an operational frequency range of the AoSA.

In some embodiments, the distance is the distance is determined based on $$\frac{2L^2}{\lambda},$$

where L is the largest value of either the maximum linear dimension of the subarray of the AoSA or the maximum linear dimension of a subset of the plurality of configurable elements corresponding to the subarray and λ is a wavelength defined as c/f where c is the speed of light and f is the frequency that belongs to the operational frequency range of the AoSA.

In some embodiments, the plurality of configurable elements are configured to redirect the signal transmitted by the plurality of antenna elements so that the signal passes through the plurality of configurable elements of the RIS.

In some embodiments, the plurality of configurable elements are configured to redirect the signal transmitted by the plurality of antenna elements so that the signal is reflected off of the plurality of configurable elements of the RIS.

Figure 12:
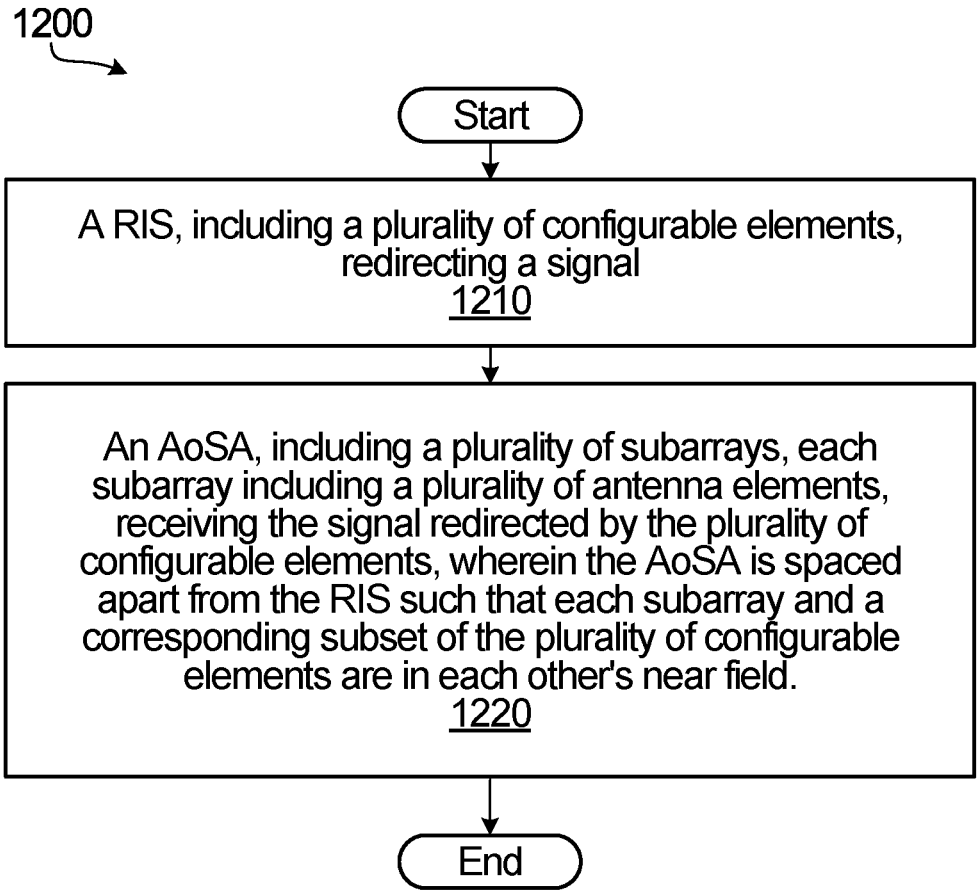
FIG. 12 is a flow chart illustrating a method for receiving a signal using a combined subarray antenna array and RIS according to an aspect of the application.

FIG. 12 is an example flow diagram 1200 that describes a method for an antenna that is receiving using the subarray antenna array and RIS as described in various embodiments above.

The method involves a RIS, including a plurality of configurable elements, redirecting 1210 a signal. Another step involves an AoSA, including a plurality of subarrays, each subarray including a plurality of antenna elements, receiving 1220 the signal redirected by the plurality of configurable elements. The AoSA is spaced apart from the RIS such that each subarray and a corresponding subset of the plurality of configurable elements are in each other's near field. The near field is less than a distance determined in accordance with a maximum linear dimension of a subarray of the AoSA or a subset of the plurality of configurable elements corresponding to the subarray and a frequency that belongs to an operational frequency range of the AoSA.

In some embodiments, the distance is determined based on $$\frac{2L^2}{\lambda},$$

where L is the largest value of either the maximum linear dimension of the subarray of the AoSA or the maximum linear dimension of a subset of the plurality of configurable elements corresponding to the subarray and λ is a wavelength defined as c/f where c is the speed of light and f is the frequency that belongs to the operational frequency range of the AoSA.

In some embodiments, the plurality of configurable elements are configured to redirect the signal so that the signal passes through the plurality of configurable elements of the RIS before being received by the AoSA.

In some embodiments, the plurality of configurable elements are configured to redirect the signal so that the signal is reflected off of the plurality of configurable elements of the RIS before being received by the AoSA.

It should be appreciated that one or more steps of the embodiment methods provided herein may be performed by corresponding units or modules. For example, a signal may be transmitted by a transmitting unit or a transmitting module. A signal may be received by a receiving unit or a receiving module. A signal may be processed by a processing unit or a processing module. The respective units/modules may be hardware, software, or a combination thereof. For instance, one or more of the units/modules may be an integrated circuit, such as field programmable gate arrays (FPGAs) or application-specific integrated circuits (ASICs). It will be appreciated that where the modules are software, they may be retrieved by a processor, in whole or part as needed, individually or together for processing, in single or multiple instances as required, and that the modules themselves may include instructions for further deployment and instantiation.

Although a combination of features is shown in the illustrated embodiments, not all of them need to be combined to realize the benefits of various embodiments of this disclosure. In other words, a system or method designed according to an embodiment of this disclosure will not necessarily include all of the features shown in any one of the Figures or all of the portions schematically shown in the Figures. Moreover, selected features of one example embodiment may be combined with selected features of other example embodiments.

While this disclosure has been described with reference to illustrative embodiments, this description is not intended to be construed in a limiting sense. Various modifications and combinations of the illustrative embodiments, as well as other embodiments of the disclosure, will be apparent to persons skilled in the art upon reference to the description. It is therefore intended that the appended claims encompass any such modifications or embodiments.

What is claimed is:

1. A device comprising:

an array of subarrays (AoSA) comprising a plurality of subarrays, each subarray comprising a plurality of antenna elements; and a reconfigurable intelligent surface (RIS) comprising a plurality of configurable elements, wherein the AoSA and the RIS are spaced apart from one another such that each subarray and a corresponding subset of the plurality of configurable elements are in each other's near field, the near field being less than a distance determined in accordance with a maximum linear dimension of a subarray of the AoSA or a subset of the plurality of configurable elements corresponding to the subarray and a frequency that belongs to an operational frequency range of the AoSA, wherein the distance is determined based on $$\frac{2L^2}{\lambda},$$

where L is the largest value of either the maximum linear dimension of the subarray of the AoSA or the maximum linear dimension of a subset of the plurality of configurable elements corresponding to the subarray and λ is a wavelength defined as c/f where c is the speed of light and f is the frequency that belongs to the operational frequency range of the AoSA.

2. The device of claim 1, wherein the plurality of antenna elements are spaced apart from one another by greater than 0.5λ.

3. The device of claim 1, wherein the configurable elements are spaced apart from one another by less than 1λ.

4. The device of claim 1, wherein the AoSA and the RIS are spaced apart from one another by between 2λ to 5λ.

5. The device of claim 1, wherein each antenna element of the AoSA illuminates a subset of the plurality of configurable elements of the RIS.

6. The device of claim 1, wherein the plurality of configurable elements are configured so that:

a signal radiated by the AoSA passes through the RIS; or a signal received by the AoSA passes through the RIS before being received.

7. The device of claim 1, wherein the plurality of configurable elements of the RIS are configured so that:

a signal radiated by the AoSA is reflected off of the RIS; or a signal received by the AoSA is reflected off of the RIS before being received.

8. The device of claim 1, wherein the AoSA and the RIS are parallel with respect to one another, or the AoSA and the RIS are not parallel with respect to one another.

9. The device of claim 1, wherein the AoSA are arranged in any one of:

a linear array;

a two-dimensional flat surface; or a three-dimensional curved surface.

10. The device of claim 1, wherein the RIS is one of:

a single panel comprising the plurality of configurable elements;

two or more panels comprising the plurality of configurable elements; or a three-dimensional curved surface comprising the plurality of configurable elements.

11. The device of claim 1, wherein the plurality of antenna elements comprises at least one pair of antenna elements wherein the pair of antenna elements have different respective polarizations and the pair of antenna elements illuminates the same set of the plurality of configurable elements.

12. The device of claim 1, wherein the plurality of antenna elements are arranged in sets of antenna elements in which antenna elements in each set of antenna elements are spaced apart from one another by less than λ and the sets of antenna elements are spaced apart from one another by at least 2λ.

13. The device of claim 1, wherein a number of the plurality of configurable elements is greater than a number of the antenna elements of the AoSA or the sets of antenna elements of the AoSA.

14. A method comprising:

transmitting, by an array of subarrays (AoSA) comprising a plurality of subarrays, each subarray comprising a plurality of antenna elements, a signal; and redirecting the transmitted signal, by a reconfigurable intelligent surface (RIS) comprising a plurality of configurable elements, wherein the AoSA and the RIS are spaced apart from one another such that each subarray and a corresponding subset of the plurality of configurable elements are in each other's near field, the near field being less than a distance determined in accordance with a maximum linear dimension of a subarray of the AoSA or a subset of the plurality of configurable elements corresponding to the subarray and a frequency that belongs to an operational frequency range of the AoSA, wherein the distance is determined based on $$\frac{2L^2}{\lambda},$$

where L is the largest value of either the maximum linear dimension of the subarray of the AoSA or the maximum linear dimension of a subset of the plurality of configurable elements corresponding to the subarray and λ is a wavelength defined as c/f where c is the speed of light and f is the frequency that belongs to the operational frequency range of the AoSA.

15. The method of claim 14, wherein the plurality of configurable elements are configured to redirect the signal transmitted by the plurality of antenna elements so that the signal:

passes through the plurality of configurable elements of the RIS; or is reflected off of the plurality of configurable elements of the RIS.

16. A method comprising:

redirecting, by a reconfigurable intelligent surface (RIS) comprising a plurality of configurable elements, a signal;

receiving, by an array of subarrays (AoSA) comprising a plurality of subarrays, each subarray comprising a plurality of antenna elements, the signal redirected by the plurality of configurable elements, wherein the AoSA and the RIS are spaced apart from one another such that each subarray and a corresponding subset of the plurality of configurable elements are in each other's near field, the near field being less than a distance determined in accordance with a maximum linear dimension of a subarray of the AoSA or a subset of the plurality of configurable elements corresponding to the subarray and a frequency that belongs to an operational frequency range of the AoSA, wherein the distance is determined based on $$\frac{2L^2}{\lambda},$$

where L is the lamest value of either the maximum linear dimension of the subarray of the AoSA or the maximum linear dimension of a subset of the plurality of configurable elements corresponding to the subarray and λ is a wavelength defined as c/f where c is the speed of light and f is the frequency that belongs to the operational frequency range of the AoSA.

17. The method of claim 16, wherein the plurality of configurable elements are configured to redirect the signal so that the signal:

passes through the plurality of configurable elements of the RIS before being received by the AoSA; or is reflected off of the plurality of configurable elements of the RIS before being received by the AoSA.

18. The device of claim 1, wherein the AoSA and the RIS produce one or more beams where the width of each beam depends on spacing between the plurality of antenna elements, and wherein side-lobes resulting from the AoSA are attenuated by the RIS.

19. The method of claim 14, wherein the AoSA and the RIS produce one or more beams where the width of each beam depends on spacing between the plurality of antenna elements, and wherein side-lobes resulting from the AoSA are attenuated by the RIS.

20. The method of claim 16, wherein the AoSA and the RIS produce one or more beams where the width of each beam depends on spacing between the plurality of antenna elements, and wherein side-lobes resulting from the AoSA are attenuated by the RIS.

* * * * *